US010913299B2

(12) United States Patent
Kamijima

(10) Patent No.: US 10,913,299 B2
(45) Date of Patent: Feb. 9, 2021

(54) LIQUID DISCHARGING APPARATUS AND DRIVING CIRCUIT

(71) Applicant: Seiko Epson Corporation, Tokyo (JP)

(72) Inventor: Masayuki Kamijima, Ina (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/667,013

(22) Filed: Oct. 29, 2019

(65) Prior Publication Data

US 2020/0130391 A1 Apr. 30, 2020

(30) Foreign Application Priority Data

Oct. 30, 2018 (JP) ..... 2018-203607

(51) Int. Cl.
*B41J 29/38* (2006.01)
*B41J 2/045* (2006.01)
*B41J 19/20* (2006.01)

(52) U.S. Cl.
CPC ..... *B41J 29/38* (2013.01); *B41J 2/0458* (2013.01); *B41J 2/04541* (2013.01); *B41J 19/207* (2013.01)

(58) Field of Classification Search
CPC ..... B41J 29/38; B41J 2/0458; B41J 2/04541; B41J 19/207; B41J 2/04546; B41J 2/04593; B41J 2/04588; B41J 2/04596; B41J 2/15; B41J 2/04581; B41J 2202/08; B41J 2202/20; B41J 11/0095; B41J 2/17509; B41J 29/13; B41J 19/005; B41J 2/01; B41J 2/04501
See application file for complete search history.

(56) References Cited

U.S. PATENT DOCUMENTS

2002/0080218 A1 6/2002 Kaga et al.
2006/0214985 A1* 9/2006 Endo ..... B41J 11/0065 347/37

FOREIGN PATENT DOCUMENTS

JP 2002-254755 A 9/2002

OTHER PUBLICATIONS

IP.com search (Year: 2020).*

* cited by examiner

*Primary Examiner* — Lisa Solomon
(74) *Attorney, Agent, or Firm* — Harness, Dickey & Pierce, P.L.C.

(57) ABSTRACT

A liquid discharging apparatus includes a head unit having a liquid discharging head that has a driving element, a position detection circuit that outputs a position information signal indicative of a position of the liquid discharging head, a first circuit that controls drive of the driving element based on a first signal, and a first conversion circuit that converts a first optical signal into the first signal; and a driving circuit having a second circuit that outputs a second signal, a second conversion circuit that converts the second signal into the first optical signal, a first cable, and a second cable, in which the first cable connects the first conversion circuit to the second conversion circuit, and propagates the first optical signal, and the second cable electrically couples the position detection circuit to the second circuit, and propagates the position information signal.

7 Claims, 15 Drawing Sheets

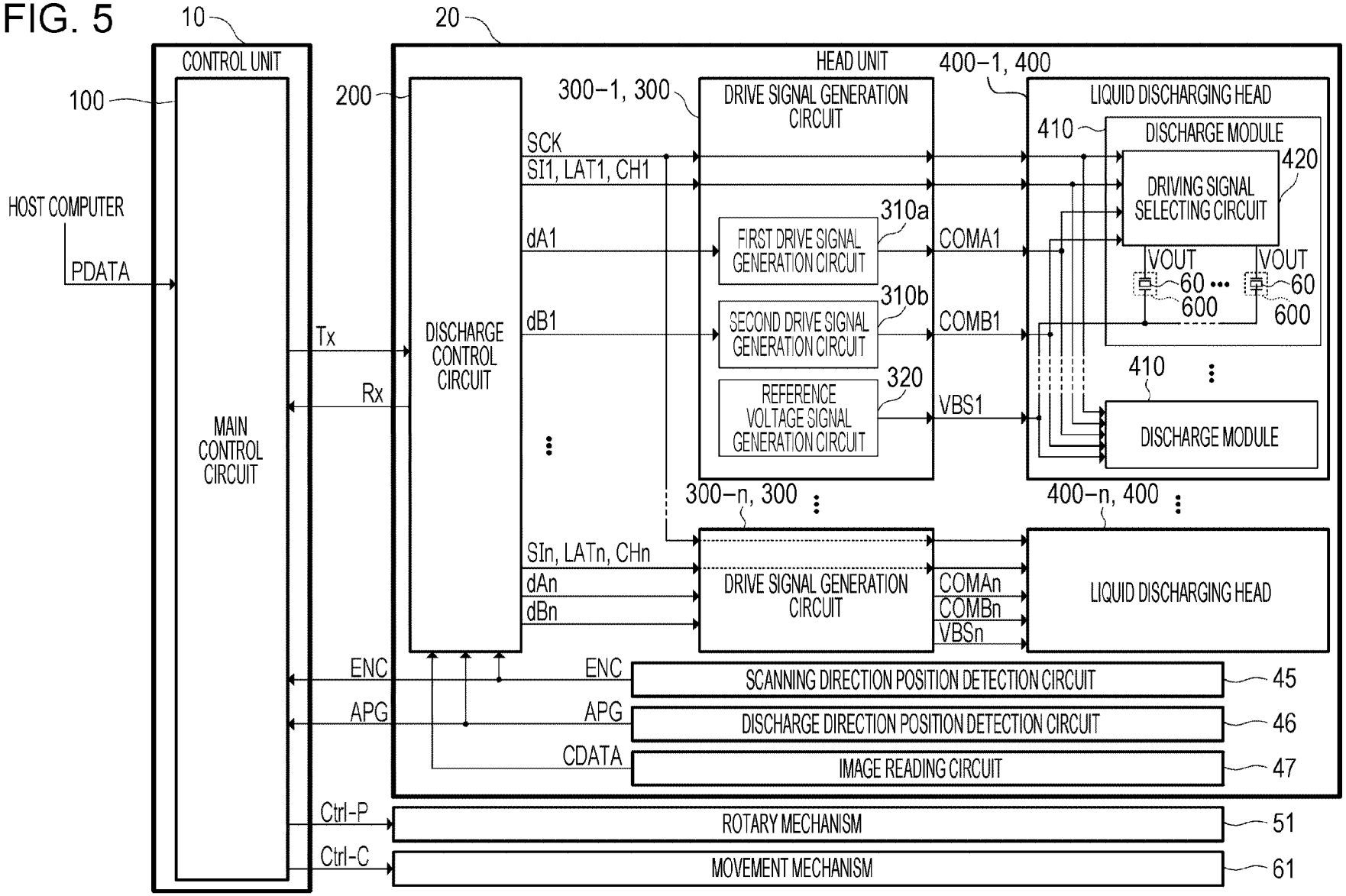
FIG. 5
HOST COMPUTER
PDATA
100
10
CONTROL UNIT
MAIN CONTROL CIRCUIT
Tx
Rx
200
20
HEAD UNIT
DRIVE SIGNAL GENERATION CIRCUIT
300−1, 300
SCK
SI1, LAT1, CH1
dA1
dB1
SIn, LATn, CHn
dAn
dBn
DISCHARGE CONTROL CIRCUIT
FIRST DRIVE SIGNAL GENERATION CIRCUIT
SECOND DRIVE SIGNAL GENERATION CIRCUIT
REFERENCE VOLTAGE SIGNAL GENERATION CIRCUIT
310a
310b
320
COMA1
COMB1
VBS1
300−n, 300
DRIVE SIGNAL GENERATION CIRCUIT
COMAn
COMBn
VBSn
400−1, 400
LIQUID DISCHARGING HEAD
DISCHARGE MODULE
DRIVING SIGNAL SELECTING CIRCUIT
420
VOUT
60
600
410
DISCHARGE MODULE
400−n, 400
LIQUID DISCHARGING HEAD
45
46
47
51
61
SCANNING DIRECTION POSITION DETECTION CIRCUIT
DISCHARGE DIRECTION POSITION DETECTION CIRCUIT
IMAGE READING CIRCUIT
ROTARY MECHANISM
MOVEMENT MECHANISM
ENC
APG
CDATA
Ctrl-P
Ctrl-C

| [SIH, SIL] | | [1, 1] LARGE DOT | [1, 0] MIDDLE DOT | [0, 1] SMALL DOT | [0, 0] NON-RECORDING |
|---|---|---|---|---|---|
| S1 | T1 | H | H | H | L |
| | T2 | H | L | L | L |
| S2 | T1 | L | L | L | H |
| | T2 | L | H | L | L |

LIQUID DISCHARGING APPARATUS AND DRIVING CIRCUIT

The present application is based on, and claims priority from, JP Application Serial Number 2018-203607, filed Oct. 30, 2018, the disclosure of which is hereby incorporated by reference herein in its entirety.

BACKGROUND

1. Technical Field

The present disclosure relates to a liquid discharging apparatus and a driving circuit.

2. Related Art

It has been known that an ink jet printer, as an example of a liquid discharging apparatus, prints an image or a document on a medium by propagating a control signal, which is generated by a control circuit or the like provided on a main body of the ink jet printer, to a print head (liquid discharging head) which includes nozzles for discharging ink, and by controlling discharge timing at which the ink is discharged from the nozzles based on the control signal. In the liquid discharging apparatus, the control signal, which is supplied to the liquid discharging head, is propagated through a cable which connects the main body of the ink jet printer to the liquid discharging head.

JP-A-2002-254755 discloses a technology for propagating a lot of data signals by connecting a main body of a liquid discharging apparatus to a liquid discharging head using one optical fiber and converting the data signals into optical signals.

In order to increase a landing accuracy of the ink discharged from the nozzles, the liquid discharging head is provided with, in addition to the nozzles for discharging the ink, a sensor element for detecting a scanning position of the liquid discharging head, a positional relationship between the liquid discharging head and the medium, and the like. Further, a signal indicative of the position information detected by the sensor element is propagated to both the liquid discharging head and the main body of the liquid discharging apparatus and is used for various control. When all the signals, including the signal indicative of the position information, are converted into the optical signals and are propagated, a time difference is generated due to conversion time, in which the electric signal is converted into the optical signal, or the like. As a result, the time difference is generated between an actual position of the liquid discharging head and discharge timing of the ink discharged by the liquid discharging head, and thus there is a problem in that it is not possible to land the ink at an accurate position on the medium.

SUMMARY

According to an aspect of the present disclosure, there is provided a liquid discharging apparatus including: a head unit; and a driving circuit that drives the head unit, in which the head unit includes a liquid discharging head that has a driving element, and that discharges a liquid with respect to a medium by driving the driving element, a position detection circuit that outputs a position information signal indicative of a position of the liquid discharging head, a first circuit that controls drive of the driving element based on a first signal, and a first conversion circuit that is electrically coupled to the first circuit, and that converts a first optical signal into the first signal, the driving circuit includes a second circuit that outputs a second signal, a second conversion circuit that is electrically coupled to the second circuit, and that converts the second signal into the first optical signal, a first cable, and a second cable, the first cable connects the first conversion circuit to the second conversion circuit, and propagates the first optical signal, and the second cable electrically couples the position detection circuit to the second circuit, and propagates the position information signal.

In the liquid discharging apparatus, the second signal may be a signal indicative of image data to be formed on the medium.

In the liquid discharging apparatus, may further include a carriage on which the liquid discharging head is mounted, and which moves while facing the medium, in which the position information signal may include a first position information signal indicative of the position of the liquid discharging head in a direction in which the carriage moves.

In the liquid discharging apparatus, the position information signal may include a second position information signal indicative of the position of the liquid discharging head in a direction in which the liquid is discharged with respect to the medium.

In the liquid discharging apparatus, the head unit may include an image reading circuit that acquires image information formed on the medium, the image reading circuit may output an image information signal indicative of the acquired image information, and the image information signal may be converted into a second optical signal in the first conversion circuit, and is propagated through the first cable.

In the liquid discharging apparatus, the second cable may be a flexible flat cable.

According to another aspect of the present disclosure, there is provided a driving circuit for driving a head unit including a liquid discharging head that has a driving element, and that discharges a liquid with respect to a medium by driving the driving element, a position detection circuit that outputs a position information signal indicative of a position of the liquid discharging head, a first circuit that controls drive of the driving element based on a first signal, and a first conversion circuit that is electrically coupled to the first circuit, and that converts a first optical signal into the first signal, the driving circuit including: a second circuit that outputs a second signal, a second conversion circuit that is electrically coupled to the second circuit, and that converts the second signal into the first optical signal, a first cable, and a second cable, in which the first cable may connect the first conversion circuit to the second conversion circuit, and may propagate the first optical signal, and the second cable may electrically couple the position detection circuit to the second circuit, and may propagate the position information signal.

BRIEF DESCRIPTION OF THE DRAWINGS

FIG. 5 is a block diagram showing an electrical configuration of the liquid discharging apparatus.

DESCRIPTION OF EXEMPLARY EMBODIMENTS

Hereinafter, exemplary embodiments of the present disclosure will be described with reference to the accompanying drawings. The used drawings are for convenience of description. The embodiments described below do not wrongfully limit the scope of the present disclosure as set forth in the claims. Further, not all of configurations described below are necessarily essential configuration requirements of the present disclosure.

1. Outline of Liquid Discharging Apparatus

A configuration of a liquid discharging apparatus 1 according to the present embodiment will be described with reference to FIGS. 1 to 4.

Figure 1:
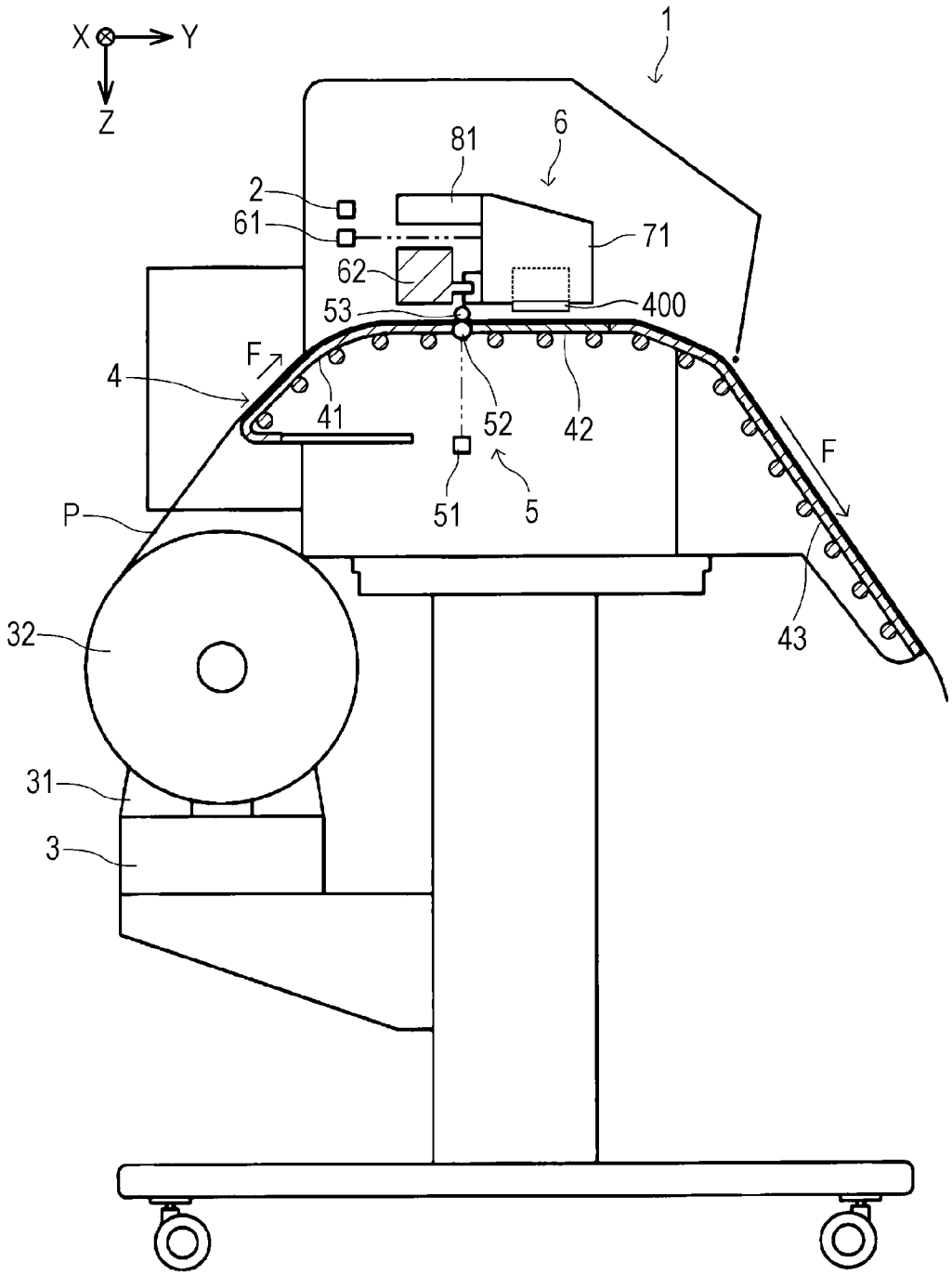
FIG. 1 is a side view showing a configuration of a liquid discharging apparatus.
Figure 2:
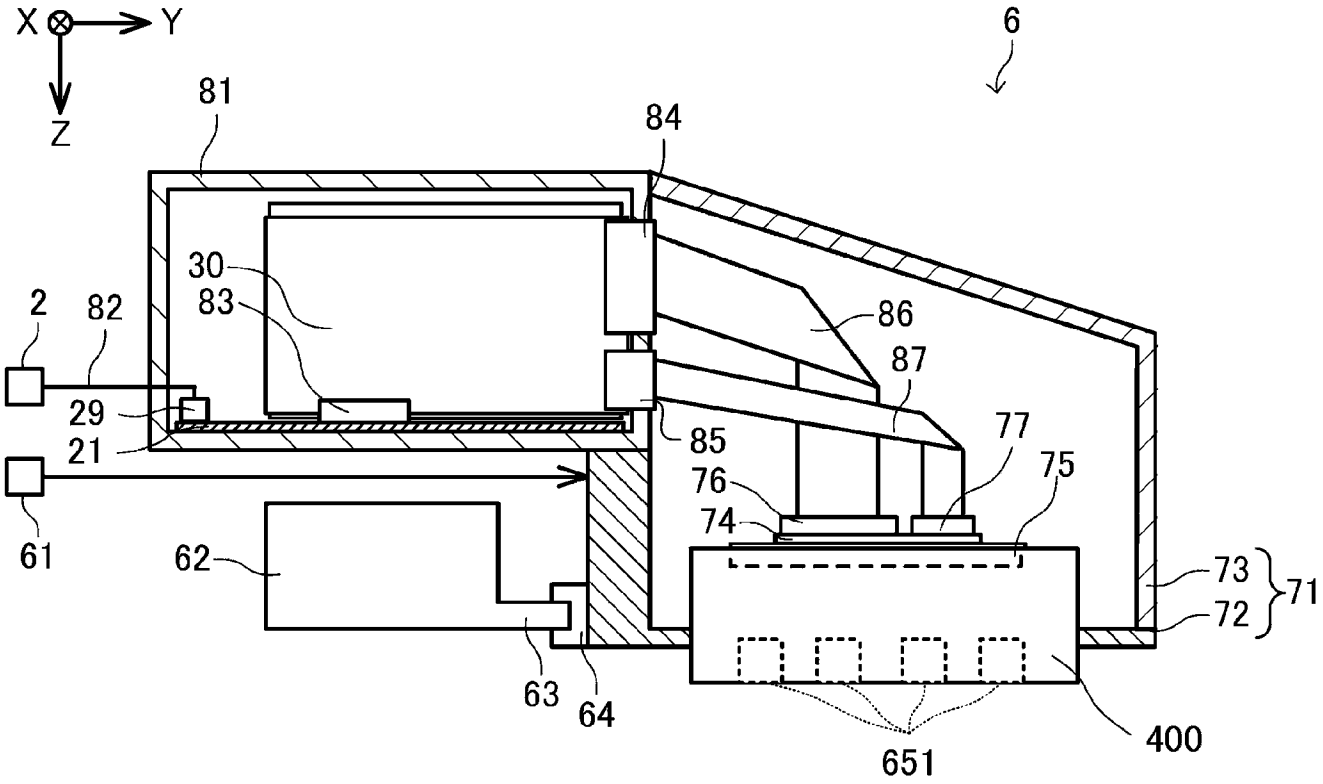
FIG. 2 is a side view showing a peripheral configuration of a printing portion of the liquid discharging apparatus.
Figure 3:
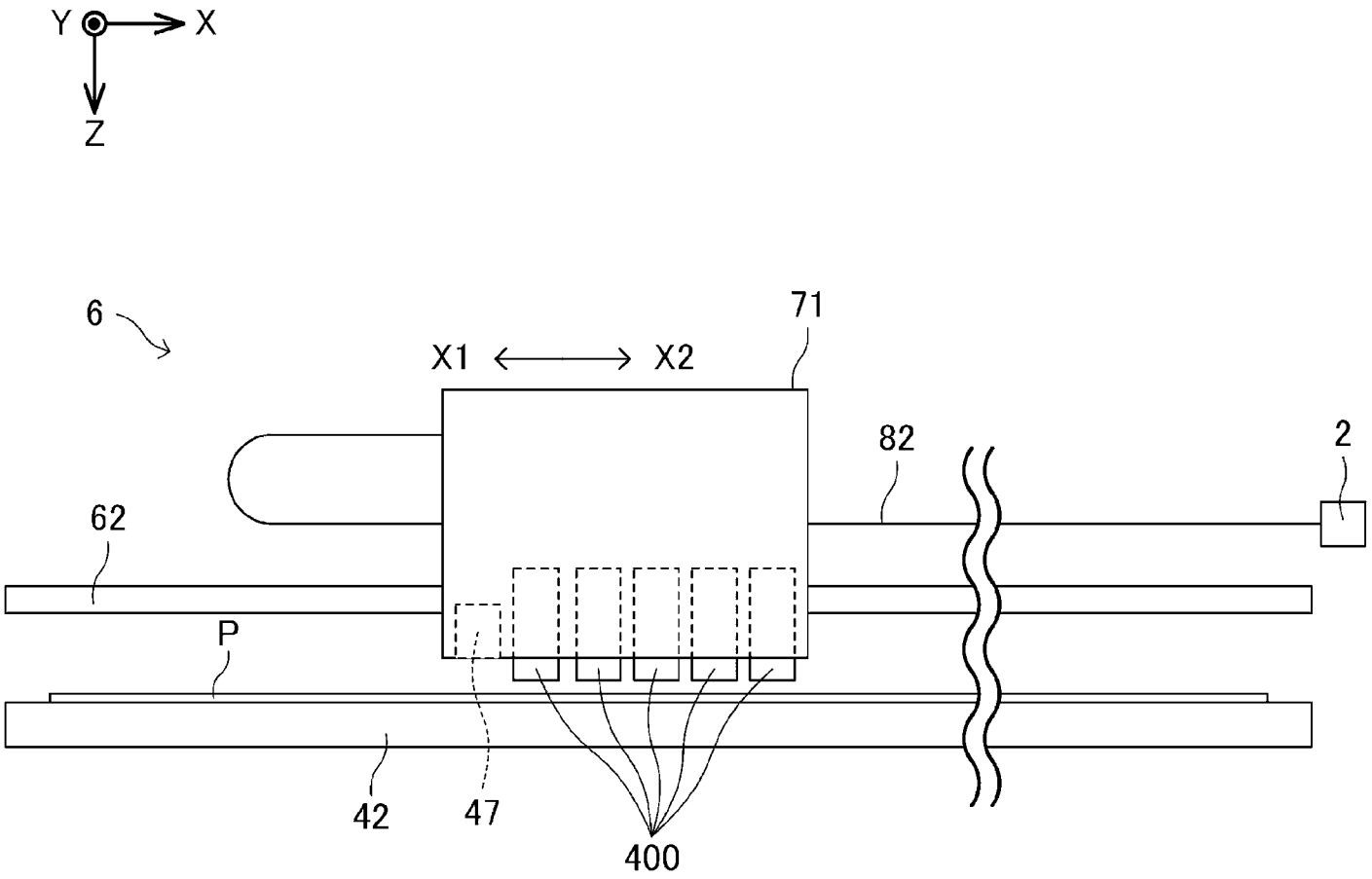
FIG. 3 is a front view showing the peripheral configuration of the printing portion of the liquid discharging apparatus.
Figure 4:
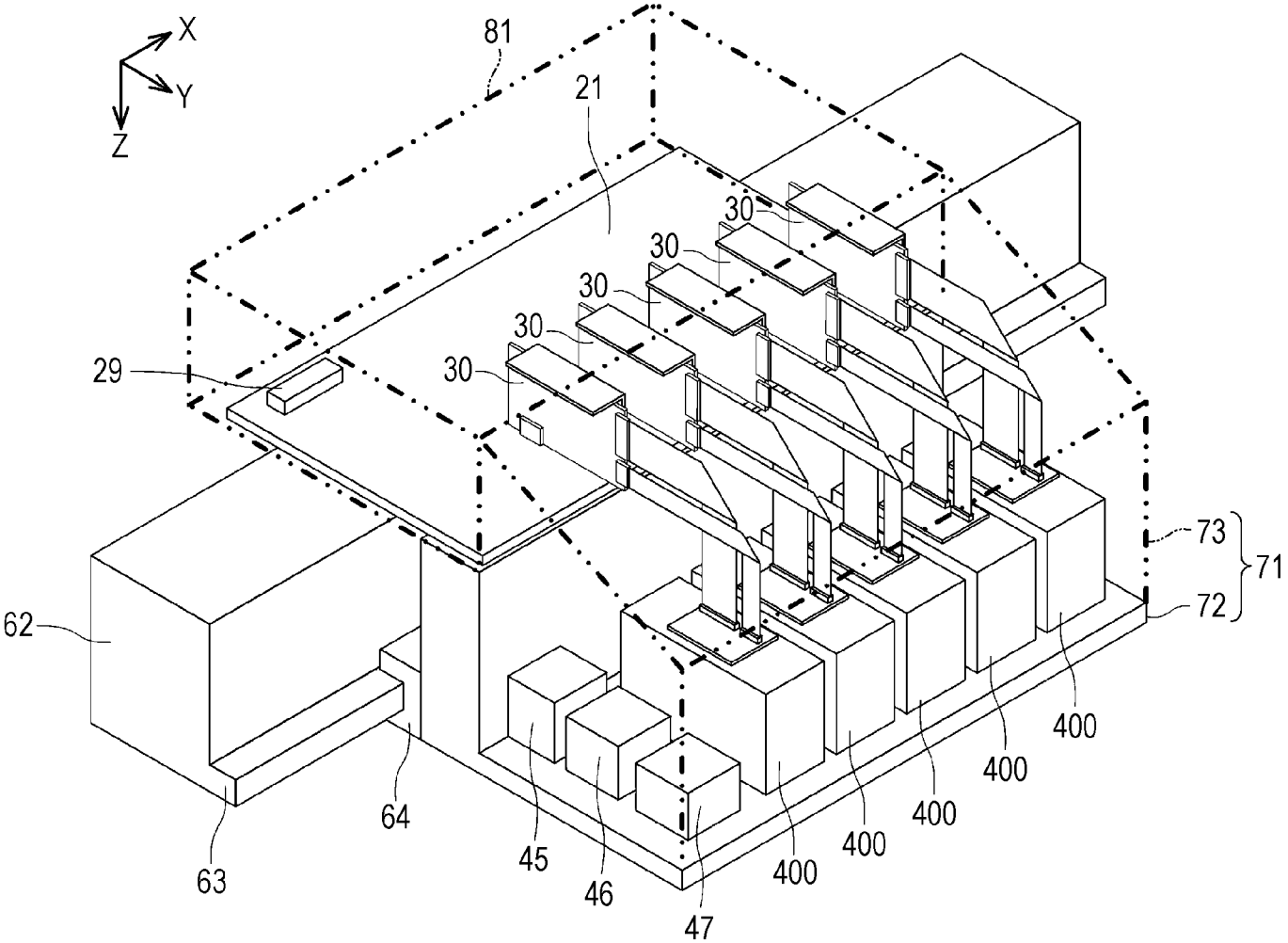
FIG. 4 is a perspective view showing the peripheral configuration of the printing portion of the liquid discharging apparatus.

FIG. 1 is a side view showing a configuration of a liquid discharging apparatus 1. FIG. 2 is a side view showing a peripheral configuration of a printing portion 6 of the liquid discharging apparatus 1. FIG. 3 is a front view showing the peripheral configuration of the printing portion 6 of the liquid discharging apparatus 1. FIG. 4 is a perspective view showing the peripheral configuration of the printing portion 6 of the liquid discharging apparatus 1.

As shown in FIG. 1, the liquid discharging apparatus 1 includes a delivery portion 3 that delivers a medium P, a support portion 4 that supports the medium P, a transport portion 5 that transports the medium P, a printing portion 6 that performs printing on the medium P, and a control portion 2 that controls these configurations.

In the following description, the width direction of the liquid discharging apparatus 1 is referred to as an X direction, the depth direction of the liquid discharging apparatus 1 is referred to as a Y direction, and the height direction of the liquid discharging apparatus 1 is referred to as a Z direction. Further, a direction in which the medium P is transported is referred to as a transport direction F. The X direction, the Y direction, and the Z direction are perpendicular to each other. Further, the transport direction F intersects the X direction.

The control portion 2 is fixed to an inside of the liquid discharging apparatus 1 to generate various signals for controlling the liquid discharging apparatus 1 and to output the generated signals to corresponding various configurations.

The delivery portion 3 includes a holding member 31. The holding member 31 rotatably holds a roll body 32 on which the medium P is wound and stacked. The holding member 31 holds different Kinds of media P and roll bodies 32 having different dimensions in the X direction. Further, in the delivery portion 3, as the roll body 32 is rotated in one direction, the medium P unwound from the roll body 32 is delivered to the support portion 4.

The support portion 4 includes a first support portion 41, a second support portion 42, and a third support portion 43, which constitute a transport path of the medium P from an upstream to a downstream in the transport direction F. The first support portion 41 guides the medium P delivered from the delivery portion 3 toward the second support portion 42. The second support portion 42 supports the medium P on which printing is performed. Further, the third support portion 43 guides the printed medium P toward the downstream in the transport direction F.

The transport portion 5 includes a transport roller 52 that applies a transport force to the medium P, a driven roller 53 that presses the medium P against the transport roller 52, and a rotary mechanism 51 that drives the transport roller 52.

The transport roller 52 is disposed beneath the transport path of the medium P in the Z direction, and the driven roller 53 is disposed on the transport path of the medium P in the Z direction. The rotary mechanism 51 is configured with, for example, a motor and a reduction gear. Further, in the transport portion 5, as the transport roller 52 rotates in a state in which the medium P is nipped by the transport roller 52 and the driven roller 53, the medium P is transported in the transport direction F.

As shown in FIGS. 2 to 4, the printing portion 6 includes a carriage 71, a guide member 62, a movement mechanism 61, and a heat dissipating case 81.

The carriage 71 includes a carriage main body 72 and a carriage cover 73, and is provided to reciprocate along the X direction in a state of facing the medium P. The carriage main body 72 forms an approximately L-shape when viewed from the X direction. The carriage cover 73 is detachably provided with respect to the carriage main body 72. Further, an enclosed space is formed when the carriage cover 73 is attached to the carriage main body 72. At a lower portion of the carriage main body 72, five liquid discharging heads 400 are mounted on the X direction at regular intervals. Each of the liquid discharging heads 400 includes a lower end portion provided to protrude outward from a lower surface of the carriage main body 72. A plurality of nozzles 651 for discharging the ink, as an example of a liquid, with respect to the medium P are formed on a lower surface of the liquid discharging head 400.

Further, a scanning direction position detection circuit 45, a discharge direction position detection circuit 46, and an image reading circuit 47 are mounted on the carriage main body 72. The scanning direction position detection circuit 45 includes a linear encoder or the like for detecting a position of the liquid discharging head 400 in the X direction to which the carriage 71 moves. Further, the discharge direction position detection circuit 46 includes a sensor element for detecting a reference position of the liquid discharging head 400 with respect to the medium P. Further, the image reading circuit 47 includes a camera or the like for acquiring image information formed on the medium P.

The guide member 62 extends along the X direction. Further, in the guide member 62, the carriage 71 is supported to reciprocate along the X direction. Specifically, the guide member 62 includes a guide rail portion 63 extending from a lower portion of a front surface of the guide member 62 in the X direction. Further, the carriage 71 has a carriage support portion 64 at a lower portion of a rear surface of the carriage 71. The carriage support portion 64 is supported to slide on the guide rail portion 63. Therefore, the carriage 71 is connected to reciprocate along the guide member 62.

The movement mechanism 61 includes a motor and a reduction gear. Further, the movement mechanism 61 controls normal rotation and reverse rotation of the motor, and converts a rotational force of the motor into a moving force in the X direction of the carriage 71. Therefore, the carriage 71 reciprocates along the X direction in a state in which the five liquid discharging heads 400, five driving circuit boards 30, and a discharge control circuit board 21 are mounted. Further, the movement mechanism 61 adjusts a position in the Z direction of the carriage 71 by controlling the motor and the reduction gear. Therefore, even in a case where thickness of the medium P is different, it is possible to adjust a distance between the liquid discharging head 400 and the medium P, and thus it is possible to increase landing accuracy of the ink which lands on the medium P.

The heat dissipating case 81 has an approximately rectangular parallelepiped shape in which the discharge control circuit board 21 and the five driving circuit boards 30 are accommodated. A front end portion of the heat dissipating case 81 is fixed to an upper end portion of the rear portion of the carriage 71. That is, the discharge control circuit board 21 and the five driving circuit boards 30 are mounted on the carriage 71 through the heat dissipating case 81.

A connector 29 is provided on the discharge control circuit board 21. A plurality of cables 82 for electrically coupling the control portion 2 to the discharge control circuit board 21 are connected to the connector 29. That is, the cables 82 are for electrically coupling the discharge control circuit board 21, which is mounted on the carriage 71 that reciprocates in the X direction, to the control portion 2, which is fixed to the liquid discharging apparatus 1, and for propagating various signals. Further, the five driving circuit boards 30 are installed upward the discharge control circuit board 21 in the Z direction and are provided in parallel in the X direction. The discharge control circuit board 21 and each of the driving circuit boards 30 are connected through a connector 83 such as a Board to Board (B to B) connector.

Connectors 84 and 85 are provided at a front end portion of each of the five driving circuit boards 30. Each of the connectors 84 and 85 is exposed from a front surface of the heat dissipating case 81. One end of a cable 86 is connected to the connector 84, and one end of a cable 87 is connected to the connector 85.

Further, a connection board 74 is provided on an upper surface of each of the five liquid discharging heads 400. The connection board 74 is electrically coupled to the liquid discharging head 400 through a connector 75 such as a B to B connector. Connectors 76 and 77 are provided on the connection board 74. Another end of the cable 86 is connected to the connector 76, and another end of the cable 87 is connected to the connector 77. Therefore, the five liquid discharging heads 400 corresponding to the five driving circuit boards 30 are electrically coupled.

In the description with reference to FIGS. 1 to 4, description is performed such that the liquid discharging apparatus 1 includes the five driving circuit boards 30 and the five liquid discharging heads 400. However, the number of driving circuit boards 30 and the number of liquid discharging heads 400 are not limited to five.

As above, in the liquid discharging apparatus 1, the various signals, which are generated by the control portion 2 fixed to a main body of the liquid discharging apparatus 1, are input to various configurations including the driving circuit board 30 and the liquid discharging head 400, which are mounted on the carriage 71 provided to be reciprocated, through the cable 82. Further, the carriage 71 reciprocates along the X direction, which is the scanning direction, under the control of the movement mechanism 61, the medium P is transported along the transport direction F under the control of the rotary mechanism 51, and the liquid discharging head 400 discharges the ink along the Z direction which is an ink discharge direction. Therefore, an image is formed on the medium P.

2. Electrical Configuration of Liquid Discharging Apparatus

Subsequently, an electrical configuration of the liquid discharging apparatus 1 will be described. FIG. 5 is a block diagram showing the electrical configuration of the liquid discharging apparatus 1. As shown in FIG. 5, the liquid discharging apparatus 1 includes a control unit 10, a head unit 20, a rotary mechanism 51, and a movement mechanism 61.

The control unit 10 includes a main control circuit 100 included in the above-described control portion 2, and controls various operations of the liquid discharging apparatus 1.

The main control circuit 100 outputs a transmission signal Tx, which includes a signal acquired by performing image processing or the like on an image signal PDATA supplied from a not-shown host computer, to the head unit 20.

Further, the main control circuit 100 generates a control signal Ctrl-P for controlling transport of the medium P, and outputs the control signal Ctrl-P to the rotary mechanism 51. The rotary mechanism 51 controls rotation of the above-described transport roller 52 by controlling the above-described motor and the reduction gear according to the control signal Ctrl-P, and transports the medium P. Further, the main control circuit 100 generates a control signal Ctrl-C for controlling movement of the carriage 71, and outputs the control signal Ctrl-C to the movement mechanism 61. The movement mechanism 61 moves the carriage 71 by controlling the above-described motor, the reduction gear, and the like according to the control signal Ctrl-C.

Here, the control signals Ctrl-P and Ctrl-C are generated by the main control circuit 100 based on a scanning direction position information signal ENC generated by the scanning direction position detection circuit 45 which will be described later, and a discharge direction position information signal APG generated by the discharge direction position detection circuit 46. The control signal Ctrl-P may be supplied to the rotary mechanism 51 after signal conversion is performed by a not-shown driver circuit according to a configuration of the rotary mechanism 51, and, in the same manner, the control signal Ctrl-C may be supplied to the movement mechanism 61 after the signal conversion is performed by the not-shown driver circuit according to a configuration of the movement mechanism 61.

The head unit 20 includes a discharge control circuit 200, n number of driving signal generation circuits 300, n number of liquid discharging heads 400, the scanning direction position detection circuit 45, the discharge direction position detection circuit 46, and an image reading circuit 47. The n number of driving signal generation circuits 300 are respectively referred to as driving signal generation circuits 300-1 to **300-*n* for discrimination, and the n number of liquid discharging heads 400 are respectively referred to as liquid discharging heads 400-1 to 400-*n* for discrimination. Further, a driving signal generation circuit 300-*i* (i=any of 1 to n) is provided to correspond to a liquid discharging head 400-*i***.

The scanning direction position detection circuit 45 includes the linear encoder as described above. Further, the scanning direction position detection circuit 45 detects the position of the liquid discharging head 400 in the X direction to which the carriage 71 moves, generates the scanning direction position information signal ENC indicative of the position of the liquid discharging head 400 in the X direction, and outputs the scanning direction position information signal ENC to the main control circuit 100 and the discharge control circuit 200.

The discharge direction position detection circuit 46 includes the sensor element which detects a reference position of the liquid discharging head 400 with respect to the medium P, as described above. Further, the discharge direction position detection circuit 46 detects the position of the liquid discharging head 400 in the Z direction in which the liquid discharging head 400 discharges a liquid with respect to the medium P, generates the discharge direction position information signal APG indicative of the position of the liquid discharging head 400 in the Z direction, and outputs the discharge direction position information signal APG to the main control circuit 100 and the discharge control circuit 200. For example, the sensor element included in the discharge direction position detection circuit 46 may be a sensor element for detecting a reference position of the carriage 71 fixed to the second support portion 42 which supports the medium P on which printing is performed, or may be a sensor element for detecting a distance between the carriage 71 and the second support portion 42.

Here, the scanning direction position information signal ENC indicative of the position of the liquid discharging head 400 in a direction in which the carriage 71 moves is an example of a position information signal, that is, an example of a first position information signal. Further, the discharge direction position information signal APG indicative of the position of the liquid discharging head 400 in a direction in which the liquid is discharged with respect to the medium P is another example of the position information signal, that is, an example of a second position information signal. That is, the position information signal indicative of the position of the liquid discharging head 400 according to the exemplary embodiment includes any one of the scanning direction position information signal ENC and the discharge direction position information signal APG. Further, the scanning direction position detection circuit 45, which outputs the scanning direction position information signal ENC, is an example of a position information detection circuit, the discharge direction position detection circuit 46, which outputs the discharge direction position information signal APG, is another example of the position information detection circuit.

The image reading circuit 47 includes a camera as described above. Further, the image reading circuit 47 acquires the image information formed on the medium P, generates image information signal CDATA indicative of the acquired image information, and outputs the image information signal CDATA to the discharge control circuit 200.

The discharge control circuit 200 is provided on the above-described discharge control circuit board 21. Further, the discharge control circuit 200 generates printing data signals SI1 to SIn, latch signals LAT1 to LATn, change signals CH1 to CHn, base driving signals dA1 to dAn and dB1 to dBn, and a clock signal SCK based on the transmission signal Tx, the scanning direction position information signal ENC, the discharge direction position information signal APG, and the image information signal CDATA, and outputs the generated signals to the relevant driving signal generation circuits 300-1 to **300-*n*. Further, the discharge control circuit 200 generates a reception signal Rx, which includes a signal indicative of reception of the transmission signal Tx input from the main control circuit 100, and outputs the reception signal Rx to the main control circuit 100**.

Each of the driving signal generation circuits 300-1 to **300*n* is provided on the above-described driving circuit board 30. The driving signal generation circuit 300-1 includes a first driving signal generation circuit 310*a*, a second driving signal generation circuit 310*b*, and a reference voltage signal generation circuit 320. The base driving signal dA1, which is a digital signal, is input to the first driving signal generation circuit 310*a*. The first driving signal generation circuit 310*a* performs digital/analog signal conversion on the base driving signal dA1, generates a driving signal COMA1 by performing class D amplification on the analog signal acquired through the digital/analog signal conversion, and outputs the driving signal COMA1 to the liquid discharging head 400-1. Further, the base driving signal dB1, which is the digital signal, is input to the second driving signal generation circuit 310*b*. The second driving signal generation circuit 310*b* performs the digital/analog signal conversion on the base driving signal dB1, generates a driving signal COMB1 by performing the class D amplification on the analog signal acquired through the digital/analog signal conversion, and outputs the driving signal COMB1 to the liquid discharging head 400-1. The first driving signal generation circuit 310*a* and the second driving signal generation circuit 310*b*** may have the same configuration, and, for example, may include a class A amplification circuit, a class B amplification circuit, a class AB amplification circuit, or the like.

The reference voltage signal generation circuit 320 generates a reference voltage signal VBS1 indicative of a reference potential of the driving signals COMA1 and COMB1, and outputs the reference voltage signal VBS1 to the liquid discharging head 400-1. For example, the reference voltage signal VBS1 is a signal of a DC voltage having a voltage value of 6 V.

Further, the driving signal generation circuit 300-1 propagates the printing data signal SI1, the latch signal LAT1, the change signal CH1, and the clock signal SCK, and outputs the printing data signal SI1, the latch signal LAT1, the change signal CH1, and the clock signal SCK to the liquid discharging head 400-1.

The driving signal generation circuits 300-1 to **300-*n* have the same configuration. That is, base driving signals dAi and dBi are input to the driving signal generation circuit 300-*i*. Further, the driving signal generation circuit 300-*i* generates driving signals COMAi and COMBi and a reference voltage signal VBSi, and outputs the driving signals COMAi and COMBi and the reference voltage signal VBSi to the relevant liquid discharging head 400-*i*. Further, the driving signal generation circuit 300**-*i* propagates a printing data signal SIi, a latch signal LATi, a change signal CHi, and the clock signal SCK, and outputs the printing data signal SIi, the latch signal LATi, the change signal CHi, and the clock signal SCK to the relevant liquid discharging head 400-*i*.

The liquid discharging head 400-1 includes piezoelectric elements 60 which are examples of driving elements, and discharges the liquid with respect to the medium P by driving the piezoelectric elements 60. The liquid discharging head 400-1 includes a plurality of discharge modules 410. Each of the plurality of discharge modules 410 includes a driving signal selecting circuit 420 and a plurality of discharge portions 600.

The driving signal selecting circuit 420 includes, for example, an integrated circuit (IC) apparatus. The printing data signal SI1, the latch signal LAT1, the change signal CH1, the clock signal SCK, and the driving signals COMA1 and COMB1 are input to the driving signal selecting circuit 420. Further, the driving signal selecting circuit 420 generates a driving signal VOUT by performing selection or non-selection according to the printing data signal SI1 on the input driving signals COMA1 and COMB1 at timing prescribed using the latch signal LAT1 and the change signal CH1. The driving signal VOUT generated by the driving signal selecting circuit 420 is supplied to one end of the piezoelectric element 60 included in each of the plurality of discharge portions 600.

Further, the reference voltage signal VBS1 is supplied to another end of the piezoelectric element 60 included in each of the plurality of discharge portions 600 included in the liquid discharging head 400-1. Further, the plurality of piezoelectric elements 60 are driven based on the driving signal VOUT and the reference voltage signal VBS1, and the amount of ink according to the drive is discharged.

The liquid discharging heads 400-1 to 400-*n* have the same configuration. That is, the printing data signal SIi, the latch signal LATi, the change signal CHi, the clock signal SCK, and the driving signals COMAi and COMBi are input to the liquid discharging head 400-*i*, and the driving signal VOUT is generated. Further, the generated driving signal VOUT is supplied to one end of the piezoelectric element 60 included in each of the plurality of discharge portions 600 included in the liquid discharging head 400-*i*.

Further, the reference voltage signal VBSi is supplied to another end of the piezoelectric element 60 included in each of the plurality of discharge portions 600 included in the liquid discharging head 400-*i*. Further, the plurality of piezoelectric elements 60 are driven based on the driving signal VOUT and the reference voltage signal VBSi, and the ink is discharged based on the drive.

3. Configuration and Operation of Liquid Discharging Head

Subsequently, a configuration and an operation of the liquid discharging head 400 will be described. When the configuration of the liquid discharging head 400 is described, description is performed while the printing data signal SIi, the latch signal LATi, the change signal CHi, the clock signal SCK, the driving signals COMAi and COMBi, and the reference voltage signal VBSi, which are supplied to the liquid discharging head 400, are respectively referred to as a printing data signal SI, a latch signal LAT, a change signal CH, a clock signal SCK, driving signals COMA and COMB, and a reference voltage signal VBS.

Figure 6:
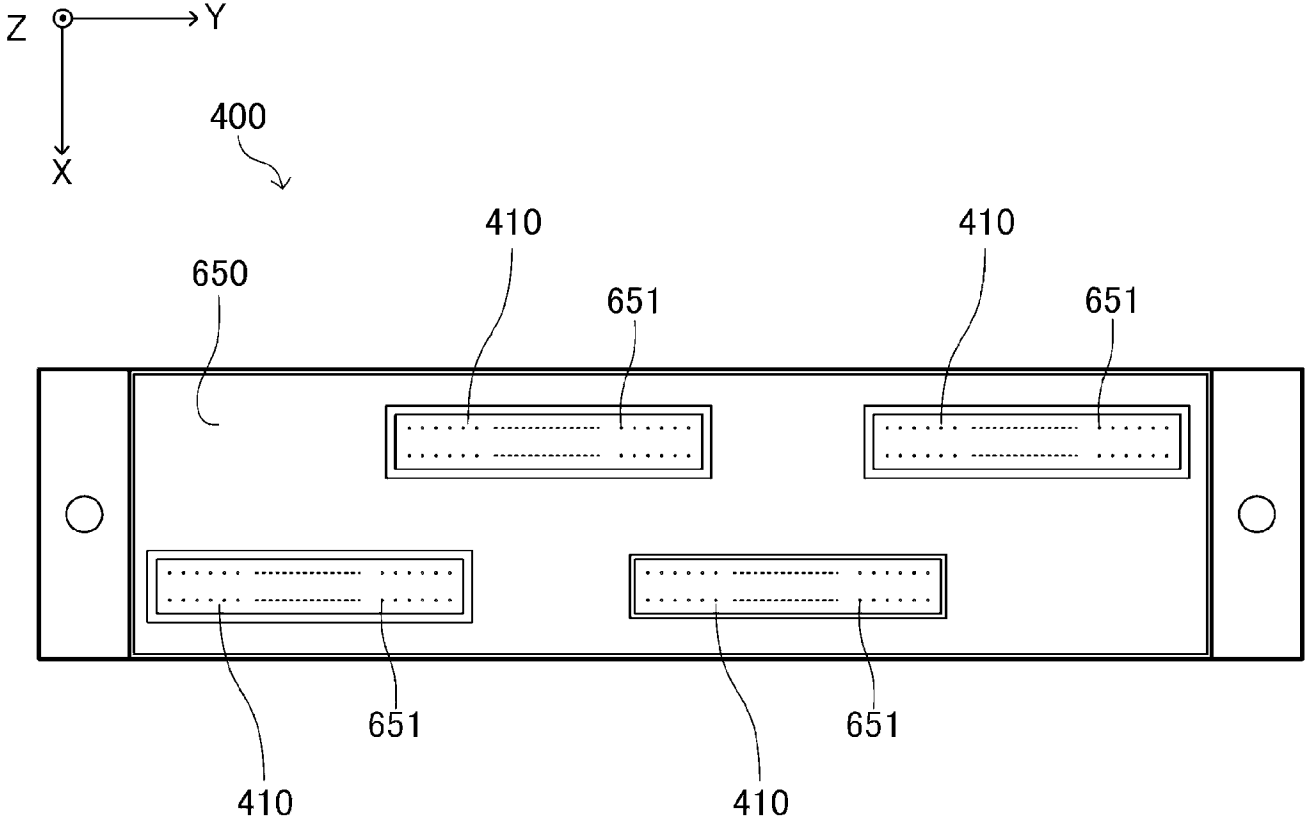
FIG. 6 is a diagram showing a configuration of an ink discharge surface.
Figure 7:
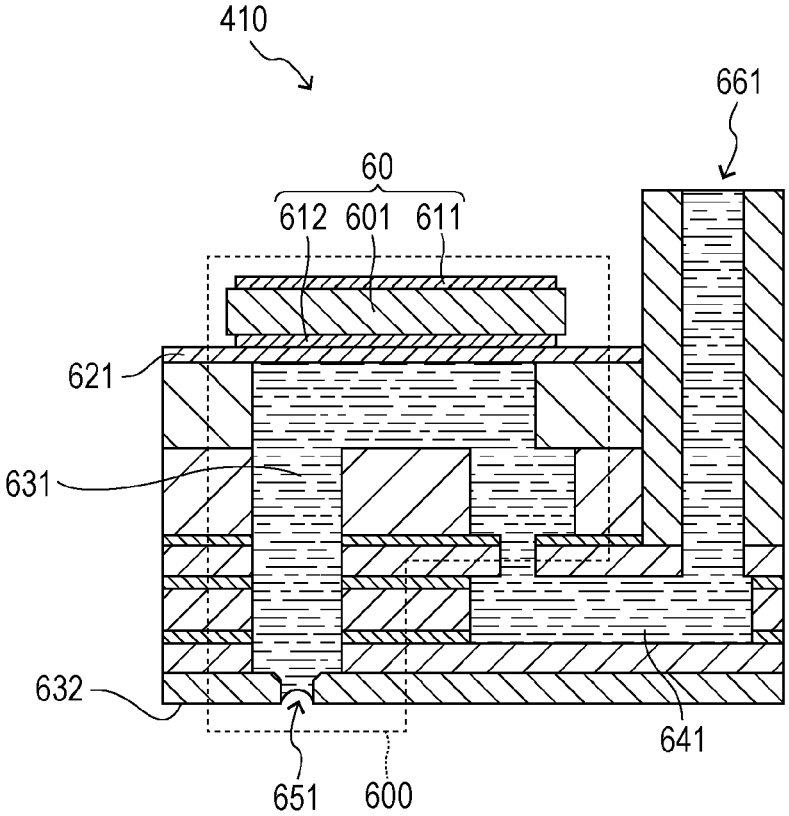
FIG. 7 is a diagram showing a schematic configuration of one of a plurality of discharge portions.

FIG. 6 is a diagram showing a configuration of the ink discharge surface 650, on which the plurality of nozzles 651 are formed, in the liquid discharging head 400. FIG. 7 is a diagram showing a schematic configuration of one of the plurality of discharge portions 600 included in the discharge module 410. As shown in FIGS. 6 and 7, the liquid discharging head 400 includes nozzles 651 for discharging the ink and the piezoelectric elements 60.

As shown in FIG. 6, four discharge modules 410 are disposed in zigzag in the liquid discharging head 400. In each of the discharge modules 410, the nozzles 651, which are provided in parallel in the Y direction, are formed in two lines in the X direction. In the discharge module 410, 300 or more number of nozzles 651 are provided in parallel for each inch along the X direction. Further, 600 or more number of nozzles 651 are provided in one discharge module 410. That is, in the liquid discharging head 400 according to the embodiment, 2400 or more number of nozzles 651 are provided. Further, a not-shown ink channel, which communicates with the nozzles 651, is provided in the discharge module 410. The number of discharge modules 410 included in the liquid discharging head 400 is not limited to four.

Further, as shown in FIG. 7, the discharge module 410 includes the discharge portion 600 and a reservoir 641. The ink is introduced from an ink supply port 661 into the reservoir 641.

The discharge portion 600 includes the piezoelectric element 60, a diaphragm 621, a cavity 631, and the nozzle 651. The diaphragm 621 is deformed according to drive of the piezoelectric element 60 provided on an upper surface in FIG. 7. The diaphragm 621 functions as a diaphragm that enlarges/reduces an internal volume of the cavity 631. The ink is filled in the cavity 631. Further, the cavity 631 functions as a compression chamber, the internal volume of which changes according to the displacement of the diaphragm 621 due to the drive of the piezoelectric element 60. The nozzle 651 is an opening portion which is formed in a nozzle plate 632 and which communicates with the cavity 631. The ink stored inside the cavity 631 is discharged from the nozzle 651 according to the change in the internal volume of the cavity 631.

The piezoelectric element 60 has a structure in which a piezoelectric body 601 is interposed between a pair of electrodes 611 and 612. In the piezoelectric body 601 having this structure, central portions of the electrodes 611 and 612 and the diaphragm 621 are bent in a vertical direction of FIG. 7 with respect to both end portions according to a potential difference between the electrode 611 and the electrode 612. In detail, the driving signal VOUT is supplied to the electrode 611 which is the one end of the piezoelectric element 60, and the reference voltage signal VBS is supplied to the electrode 612 which is the other end of the piezoelectric element 60. Further, when the voltage of the driving signal VOUT decreases, the piezoelectric element 60 is driven such that a central portion is bent upward, and when the voltage of the driving signal VOUT increases, the piezoelectric element 60 is driven such that the central portion is bent downward. When the piezoelectric element 60 is bent upward, the diaphragm 621 performs displacement upward, and internal volume of the cavity 631 is enlarged. Therefore, the ink is drawn from the reservoir 641. When the piezoelectric element 60 is bent downward, the diaphragm 621 performs displacement downward, and internal volume of the cavity 631 is reduced. Therefore, the amount of the ink according to a degree of the reduction of the internal volume of the cavity 631 is discharged from the nozzle 651. As above, the liquid discharging head 400 includes the piezoelectric element 60, and discharges the ink with respect to the medium by driving the piezoelectric element 60. The piezoelectric element 60 is not limited to the shown structure, and may have any structure that can discharge the ink according to the displacement of the piezoelectric element 60. Further, the piezoelectric element 60 is not limited to bending vibration, and may be configured to use longitudinal vibration.

Here, examples of waveforms of the driving signals COMA and COMB, which are the basis of the driving signal VOUT supplied to the piezoelectric element 60, and examples of waveforms of the driving signal VOUT will be described.

Figure 8:
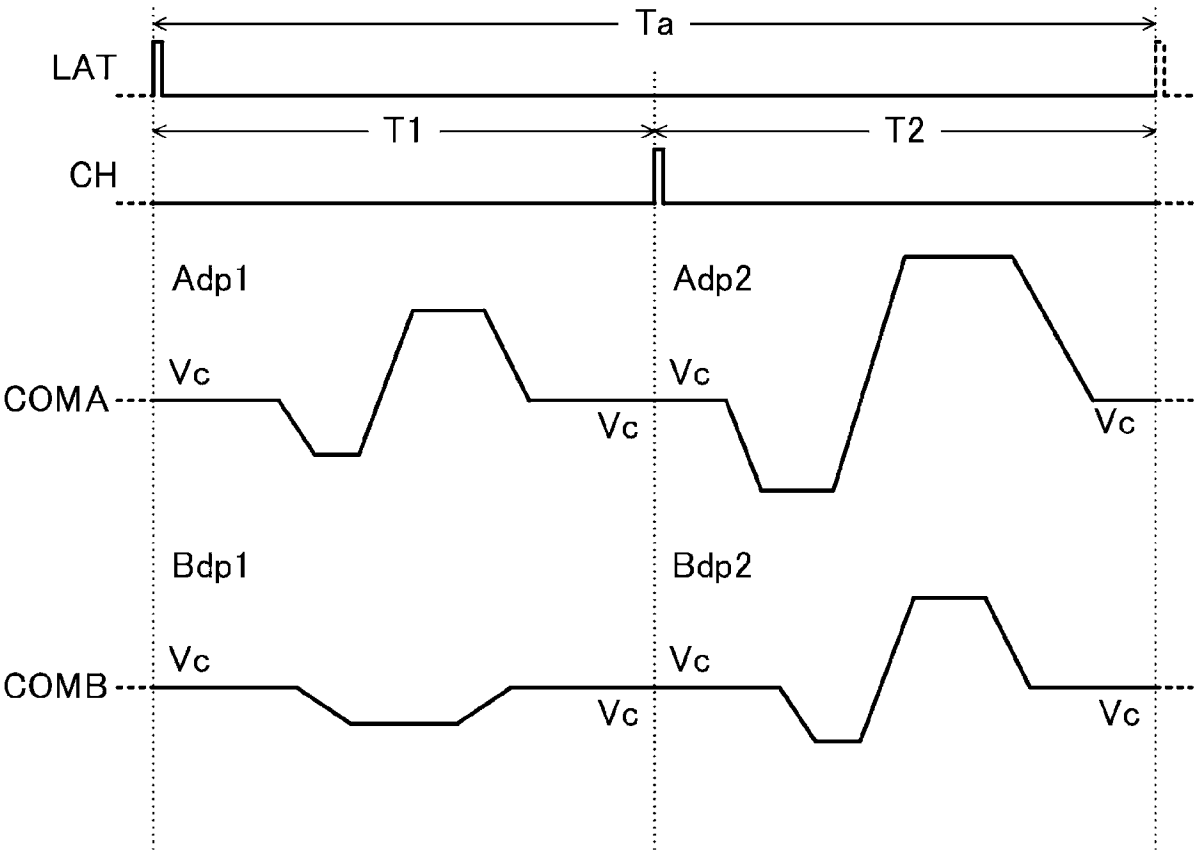
FIG. 8 is a diagram showing examples of waveforms of driving signals COMA and COMB.

FIG. 8 a diagram showing examples of the waveforms of driving signals COMA and COMB. As shown in FIG. 8, the driving signal COMA has a waveform in which a trapezoidal waveform Adp1 disposed in a period T1 from rise of the latch signal LAT to rise of the change signal CH and a trapezoidal waveform Adp2 disposed in a period T2 from the rise of the change signal CH to the rise of the latch signal LAT. Further, when the trapezoidal waveform Adp1 is supplied to the one end of the piezoelectric element 60, a small amount of ink is discharged from the discharge portion 600 corresponding to the corresponding piezoelectric element 60. When the trapezoidal waveform Adp2 is supplied to the one end of the piezoelectric element 60, a middle amount of the ink, which is larger than the small amount, is discharged from the discharge portion 600 corresponding to the corresponding piezoelectric element 60.

Further, the driving signal COMB has a waveform in which a trapezoidal waveform Bdp1 disposed in the period T1 and a trapezoidal waveform Bdp2 disposed in the period T2 are continuous. Further, when the trapezoidal waveform Bdp1 is supplied to the one end of the piezoelectric element 60, the ink is not discharged from the discharge portion 600 corresponding to the relevant piezoelectric element 60. The trapezoidal waveform Bdp1 is a waveform for finely vibrating the ink near a nozzle opening portion of the discharge portion 600 to prevent an increase in the viscosity of the ink. Further, when the trapezoidal waveform Bdp2 is supplied to the one end of the piezoelectric element 60, the small amount of the ink is discharged from the discharge portion 600 corresponding to the corresponding piezoelectric element 60, which is like a case where the trapezoidal waveform Adp1 is supplied.

Here, all voltages at start timings and termination timings of the trapezoidal waveforms Adp1, Adp2, Bdp1, and Bdp2 are commonly a voltage Vc. That is, each of the trapezoidal waveforms Adp1, Adp2, Bdp1, and Bdp2 is a waveform that starts at the voltage Vc and ends at the voltage Vc. Further, a period Ta including the period T1 and the period T2 corresponds to a printing period during which dots are formed on the medium P.

Although FIG. 8 shows that the trapezoidal waveform Adp1 and the trapezoidal waveform Bdp2 have the same waveform, the trapezoidal waveform Adp1 and the trapezoidal waveform Bdp2 may have different waveforms. Further, in the following description, it is described that the small amount of the ink is discharged both when the trapezoidal waveform Adp1 is supplied to the piezoelectric element 60 and when the trapezoidal waveform Bdp1 is supplied to the piezoelectric element 60. However, the present disclosure is not limited thereto. That is, the waveforms of the driving signals COMA and COMB are not limited to the waveforms shown in FIG. 8, and signals of combinations of various waveforms may be used according to a moving speed of the carriage 71 on which the liquid discharging head 400 is mounted, properties of the discharged ink, and materials of the medium P. Further, the waveforms of the driving signals COMA and COMB supplied to each of the plurality of liquid discharging heads 400 may be different from each other.

Figure 9:
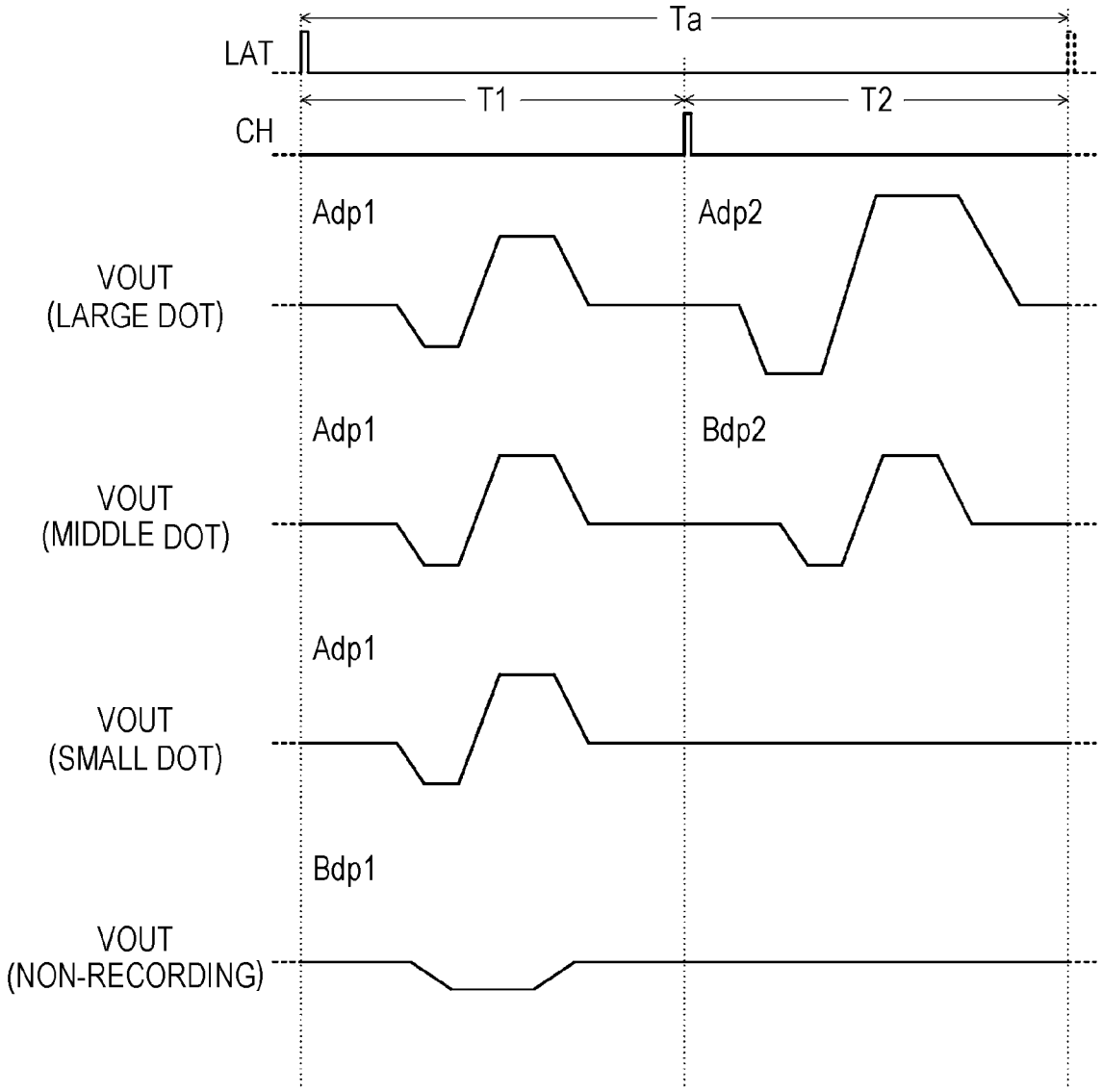
FIG. 9 is a diagram showing examples of waveforms of a driving signal VOUT.

FIG. 9 is a diagram showing examples of waveforms of the driving signal VOUT, corresponding to a "large dot", a "middle dot", and a "small dot" formed on the medium P and "non-recording", respectively.

As shown in FIG. 9, the driving signal VOUT corresponding to the "large dot" has a waveform in which, in the period Ta, the trapezoidal waveform Adp1 disposed in the period T1 and the trapezoidal waveform Adp2 disposed in the period T2 are continuous. When the driving signal VOUT is supplied to the one end of the piezoelectric element 60, in the period Ta, the small amount of the ink and the middle amount of the ink are discharged from the discharge portion 600 corresponding to the corresponding piezoelectric element 60. Thus, the ink is landed and coalesced, so that the large dot is formed on the medium P.

The driving signal VOUT corresponding to the "middle dot" has a waveform in which the trapezoidal waveform Adp1 disposed in the period T1 and the trapezoidal waveform Bdp2 disposed in the period T2 are continuous in the period Ta. When the driving signal VOUT is supplied to the one end of the piezoelectric element 60, the small amount of the ink is discharged twice from the discharge portion 600 corresponding to the corresponding piezoelectric element 60 in the period Ta. Thus, the ink is landed and coalesced, so that the middle dot is formed on the medium P.

The driving signal VOUT corresponding to the "small dot" has a waveform in which the trapezoidal waveform Adp1 disposed in the period T1 and a waveform that is disposed in the period T2 and is constant at the voltage Vc are continuous in the period Ta. When the driving signal VOUT is supplied to the one end of the piezoelectric element 60, in the period Ta, the small amount of the ink is discharged from the discharge portion 600 corresponding to the corresponding piezoelectric element 60. Thus, the ink is landed, so that the small dot is formed on the medium P.

The driving signal VOUT corresponding to the "non-recording" has a waveform in which the trapezoidal waveform Bdp1 disposed in the period T1 and a waveform that is disposed in the period T2 and is constant at the voltage Vc are continuous in the period Ta. When the driving signal VOUT is supplied to the one end of the piezoelectric element 60, in the period Ta, the ink near the nozzle opening portion of the discharge portion 600 corresponding to the corresponding piezoelectric element 60 slightly vibrates, so that the ink is not discharged. Thus, as the ink is not landed, no dot is formed on the medium P.

Here, the waveform that is constant at the voltage Vc is a waveform in which when none of the trapezoidal waveforms Adp1, Adp2, Bdp1, and Bdp2 is selected as the driving signal VOUT, the immediately preceding voltage Vc is maintained by a capacitive component of the piezoelectric element 60. When none of the trapezoidal waveforms Adp1, Adp2, Bdp1, and Bdp2 is selected as the driving signal VOUT, the voltage Vc as the driving signal VOUT is supplied to the piezoelectric element 60.

Figure 10:
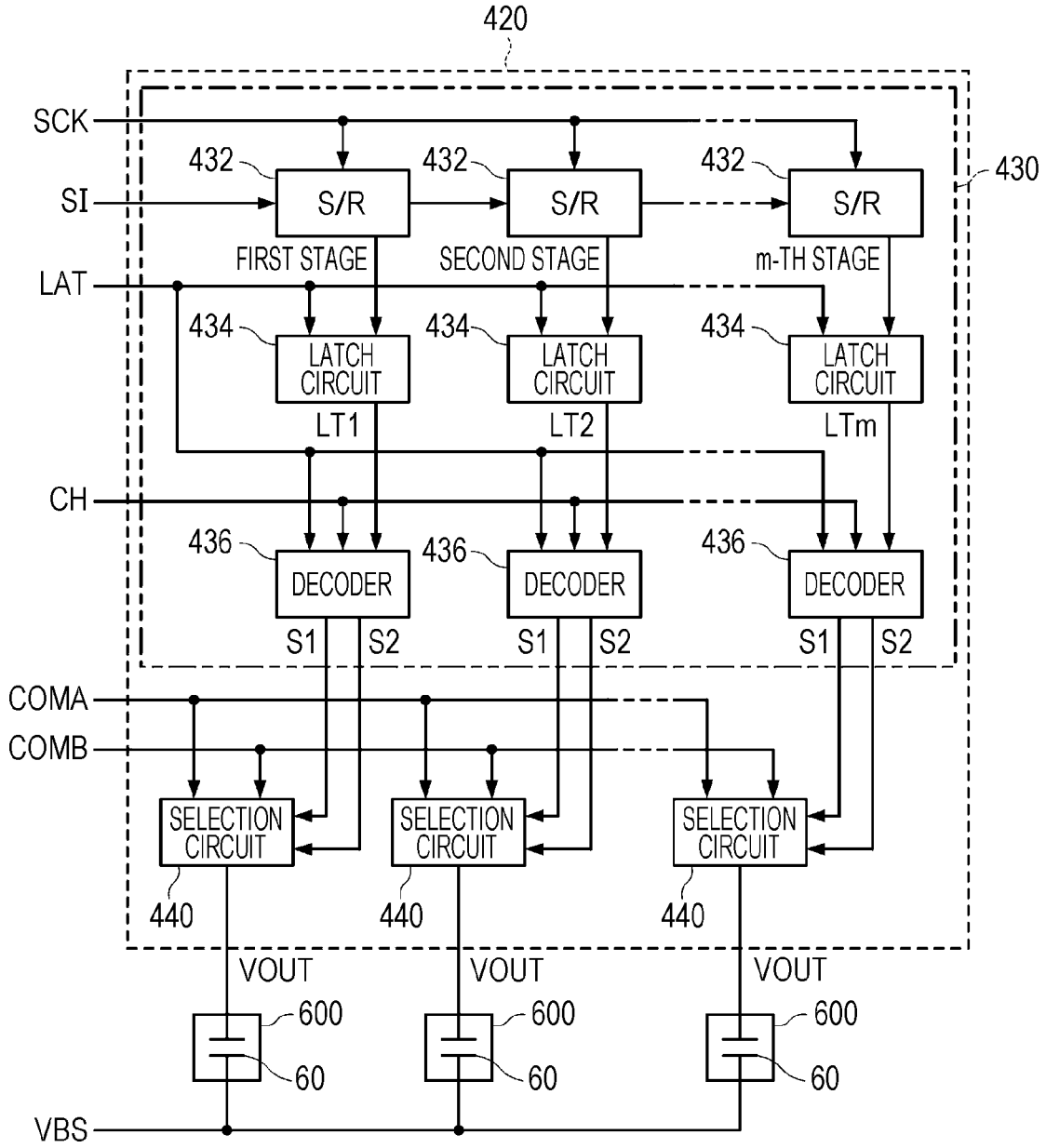
FIG. 10 is a diagram showing a configuration of a driving signal selecting circuit.

Next, a configuration and an operation of the driving signal selecting circuit 420 that selects the waveforms of the driving signals COMA and COMB and generates the driving signal VOUT will be described. FIG. 10 is a diagram showing a configuration of the driving signal selecting circuit 420. As shown in FIG. 10, the driving signal selecting circuit 420 includes the selection control circuit 430 and a plurality of selection circuits 440.

The printing data signal SI, the latch signal LAT, the change signal CH, and the clock signal SCK are input to the selection control circuit 430. Further, in the selection control circuit 430, a set of a shift register (S/R) 432, a latch circuit 434, and a decoder 436 is provided to correspond to each of the plurality of discharge portions 600. That is, the driving signal selecting circuit 420 includes the sets of the shift registers 432, the latch circuits 434, and the decoders 436, the number of which is the same as the total number m of the corresponding discharge portions 600.

In detail, the printing data signal SI is a signal synchronized with the clock signal SCK, and is a signal having 2m bits totally including 2-bit printing data [SIH, SIL] for selecting any one of the "large dot", the "middle dot", the "small dot", and the "non-recording" with respect to each of the m discharge portions 600. The printing data signal SI is held in the shift register 432 for each 2-bit printing data [SIH, SIL] included in the printing data signal SI, corresponding to the discharge portion 600. In detail, the m stages of the shift registers 432 corresponding to the discharge portions 600 are cascade-connected to each other, and the serially input printing data signal SI is sequentially transferred to the subsequent stage according to the clock signal SCK. FIG. 10, in order to distinguish the shift registers 432, the shift registers 432 are sequentially represented by a first stage, a second stage, . . . , an m-th stage from an upstream where the printing data signal SI is input.

The m latch circuits 434 latch the 2-bit printing data [SIH, SIL] held by the m shift registers 432 at rising of the latch signal LAT, respectively.

Figures 11, 12:
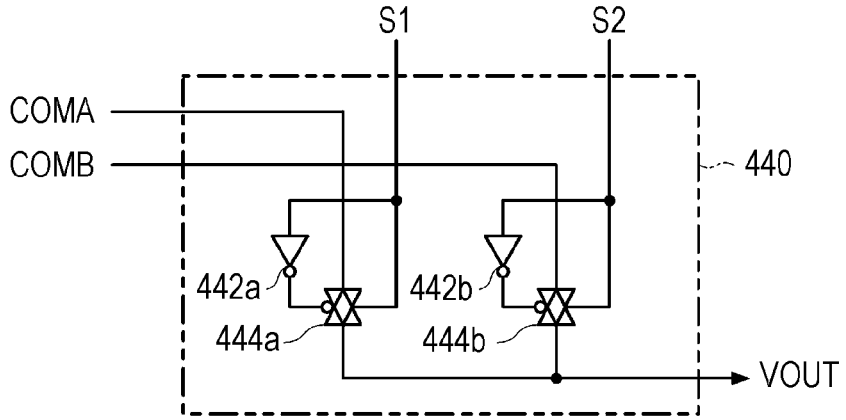
FIG. 11 is a table showing decoding content in a decoder.
FIG. 12 is a diagram showing a configuration of a selection circuit corresponding to one discharge portion.

FIG. 11 is a diagram showing decoding contents in the decoder 436. The decoder 436 outputs selection signals S1 and S2 according to the latched 2-bit printing data [SIH, SIL]. For example, when the 2-bit printing data [SIH, SIL] is [1, 0], the decoder 436 outputs a logic level of the selection signal S1 as levels H and L in the periods T1 and T2, and outputs a logic level of the selection signal S2 as levels L and H in the periods T1 and T2 to the selection circuit 440.

The selection circuits 440 are provided to correspond to the respective discharge portions 600. That is, the number of selection circuits 440 included in the driving signal selecting circuit 420 is the same as the total number m of the relevant discharge portions 600. FIG. 12 is a diagram showing a configuration of the selection circuit 440 corresponding to one discharge portion 600. As shown in FIG. 12, the selection circuit 440 includes inverters 442*a* and 442*b* which are NOT circuits, and transfer gates 444*a* and 444*b*.

The selection signal S1 is input to a positive control end not marked by a circle in the transfer gate 444*a*, is logically inverted by the inverter 442*a*, and is input to a negative control end marked by a circle in the transfer gate 444*a*. Further, the driving signal COMA is supplied to an input end of the transfer gate 444*a*. The selection signal S2 is input to a positive control end not marked by a circle in the transfer gate 444*b*, is logically inverted by the inverter 442*b*, and is input to a negative control end marked by a circle in the transfer gate 444*b*. Further, the driving signal COMB is supplied to an input end of the transfer gate 444*b*. Further, output ends of the transfer gates 444*a* and 444*b* are commonly connected to each other, and the driving signal VOUT is output.

Specifically, the transfer gate 444*a* conducts an input end and an output end when the selection signal S1 is at the level H, and does not conduct the input end and the output end when the selection signal S1 is at the level L. Further, the transfer gate 444*b* conducts the input end and an output end when the selection signal S2 is at the level H, and does not conduct the input end and the output end when the selection signal S2 is at the level L. As above, the selection circuit 440 selects the waveforms of the driving signals COMA and COMB based on the selection signals S1 and S2, and outputs the driving signal VOUT.

Figure 13:
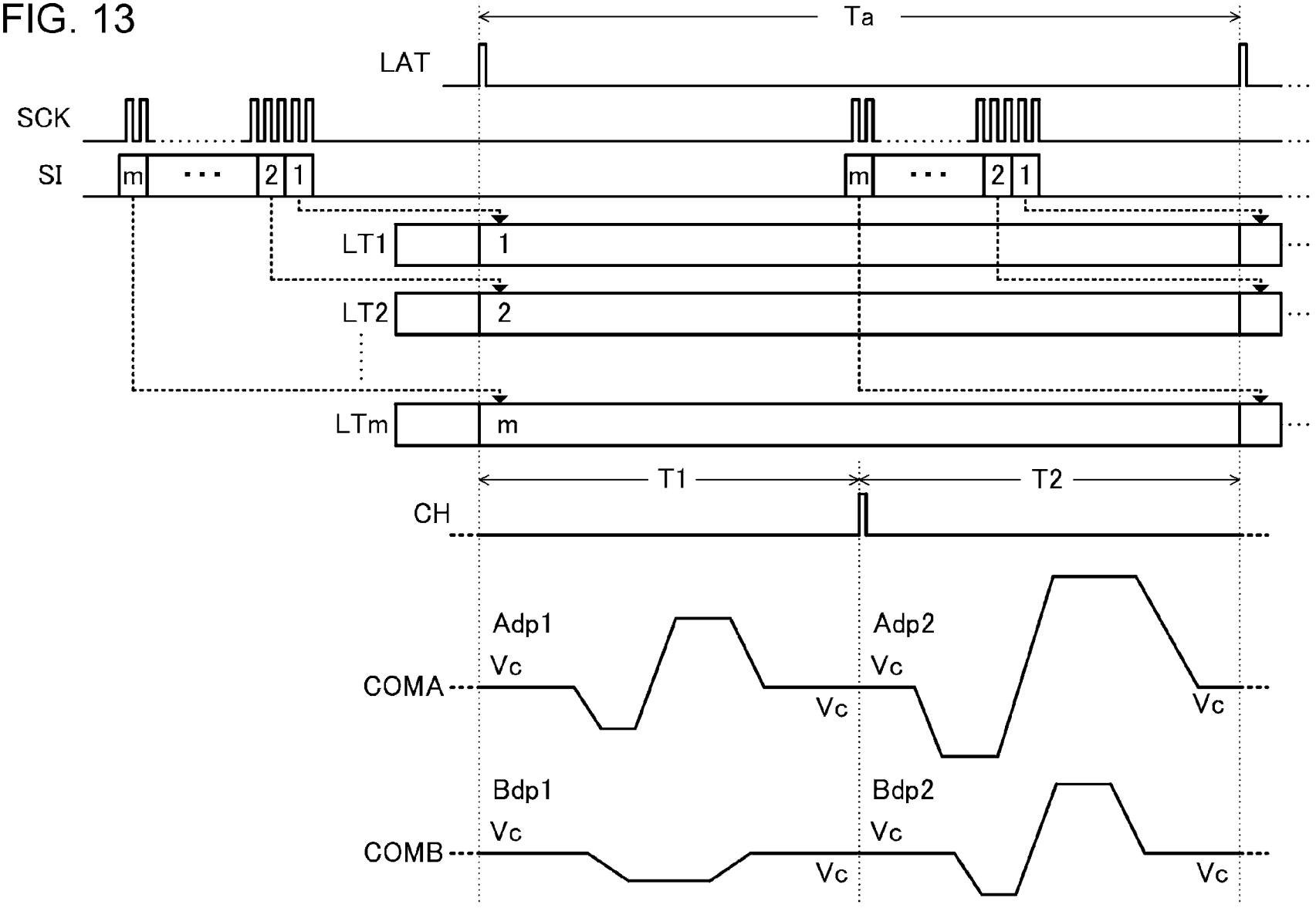
FIG. 13 is a diagram for illustrating an operation of the driving signal selecting circuit.

Here, an operation of the driving signal selecting circuit 420 will be described with reference to FIG. 13. FIG. 13 is a diagram for illustrating the operation of the driving signal selecting circuit 420. The printing data signal SI is serially input in synchronization with the clock signal SCK, and is sequentially transferred in the shift registers 432 corresponding to the discharge portions 600. Further, when the input of the clock signal SCK is stopped, the shift registers 432 hold the 2-bit printing data [SIH, SIL] corresponding to the discharge portions 600, respectively. The printing data signal SI is input in an order corresponding to the discharge portions 600 of the m-th stage, . . . , the second stage, and the first stage of the shift registers 432.

Further, when the latch signal LAT rises, the latch circuits 434 latch the 2-bit printing data [SIH, SIL] held in the shift registers 432 all at once, respectively. In FIG. 13, LT1, LT2, . . . , LTm indicate the 2-bit printing data [SIH, SIL] latched by the latch circuits 434 corresponding to the shift registers 432 of the first stage, the second stage, . . . , the m-th stage.

The decoder 436 outputs the logic levels of the selection signals S1 and S2 in the periods T1 and T2, using contents shown in FIG. 11, according to the size of a dot prescribed by the latched 2-bit printing data [SIH, SIL].

Specifically, when the printing data [SIH, SIL] is [1, 1], the decoder 436 sets the selection signal S1 to levels H and H in the periods T1 and T2, and sets the selection signal S2 to levels L and L in the periods T1 and T2. In this case, the selection circuit 440 selects the trapezoidal waveform Adp1 in the period T1, and selects the trapezoidal waveform Adp2 in the period T2. As a result, the driving signal VOUT corresponding to the "large dot" shown in FIG. 9 is generated.

Further, when the printing data [SIH, SIL] is [1, 0], the decoder 436 sets the selection signal S1 to levels H and L in the periods T1 and T2, and sets the selection signal S2 to levels L and H in the periods T1 and T2. In this case, the selection circuit 440 selects the trapezoidal waveform Adp1 in the period T1, and selects the trapezoidal waveform Bdp2 in the period T2. As a result, the driving signal VOUT corresponding to the "middle dot" shown in FIG. 9 is generated.

Further, when the printing data [SIH, SIL] is [0, 1], the decoder 436 sets the selection signal S1 to levels H and L in the periods T1 and T2, and sets the selection signal S2 to levels L and L in the periods T1 and T2. In this case, the selection circuit 440 selects the trapezoidal waveform Adp1 in the period T1, and selects neither the trapezoidal waveform Adp2 nor the trapezoidal waveform Bdp2 in the period T2. As a result, the driving signal VOUT corresponding to the "small dot" shown in FIG. 9 is generated.

Further, when the printing data [SIH, SIL] is [0, 0], the decoder 436 sets the selection signal S1 to levels L and L in the periods T1 and T2, and sets the selection signal S2 to levels H and L in the periods T1 and T2. In this case, the selection circuit 440 selects the trapezoidal waveform Bdp1 in the period T1, and selects neither the trapezoidal waveform Adp2 nor the trapezoidal waveform Bdp2 in the period T2. As a result, the driving signal VOUT corresponding to "non-recording" shown in FIG. 9 is generated.

As above, the driving signal selecting circuit 420 selects waveforms of the driving signals COMA and COMB based on the printing data signal SI, the latch signal LAT, the change signal CH, and the clock signal SCK, and outputs the driving signal VOUT. In other words, the driving signal selecting circuit 420 controls supply of the driving signals COMA and COMB to the piezoelectric element 60.

4. Details of Electrical Connection of Main Control Circuit and Discharge Control Circuit Here, details of configurations of the control unit 10 and the head unit 20 and details of signals propagated between the control unit 10 and the head unit 20 will be described.

Figure 14:
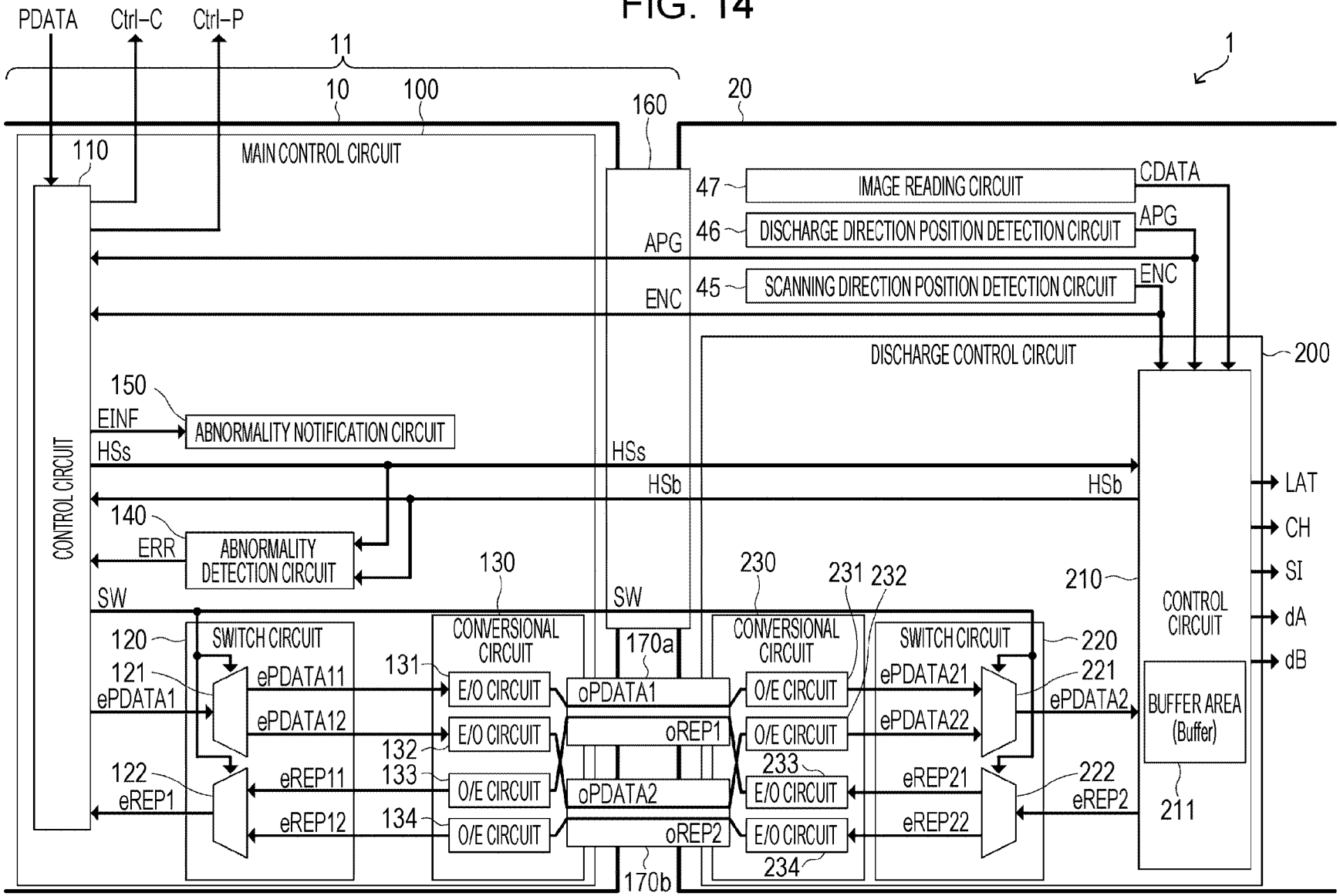
FIG. 14 is a diagram showing configurations of a control unit and a head unit.

FIG. 14 is a diagram showing configurations of the control unit 10 and the head unit 20. As shown in FIG. 14, the control unit 10 includes the main control circuit 100. The main control circuit 100 includes a control circuit 110, a switch circuit 120, a conversion circuit 130, an abnormality detection circuit 140, and an abnormality notification circuit 150.

The control circuit 110 generates an image signal ePDATA1 acquired by performing image processing on the image signal PDATA supplied from the not-shown host computer or the like. That is, the image signal ePDATA1 is a signal indicative of image data to be formed on the medium P. Further, the control circuit 110 outputs the image signal ePDATA1 to the head unit 20 through the switch circuit 120. Further, a response signal eREP1, which indicates that a signal based on the image signal ePDATA1 is input to the head unit 20, is input to the control circuit 110. Here, the control circuit 110 is an example of a second circuit, and the image signal ePDATA1, which is output by the control circuit 110, is an example of a second signal.

Further, the control circuit 110 generates a switch control signal SW for controlling the switch circuit 120 and a switch circuit 220 which will be described later and is included in the head unit 20. Further, the control circuit 110 outputs the switch control signal SW to the switch circuits 120 and 220.

Further, the control circuit 110 generates a handshake signal HSs indicative of a timing at which various signals, including the image signal ePDATA1, are transmitted. Further, the control circuit 110 outputs the handshake signal HSs to a control circuit 210 which will be described later and is included in the head unit 20. Further, a handshake signal HSb, which is output from the control circuit 210, is input to the control circuit 110.

Further, an abnormality signal ERR indicative of existence/non-existence of an abnormality on a propagation path, through which signals propagated between the control unit 10 and the head unit 20, is input to the control circuit 110 from the abnormality detection circuit 140. Further, the control circuit 110 generates an abnormality notification signal EINF based on the abnormality signal ERR, and outputs the abnormality notification signal EINF to the abnormality notification circuit 150.

Further, a scanning direction position information signal ENC generated by the scanning direction position detection circuit 45 and a discharge direction position information signal APG generated by the discharge direction position detection circuit 46 are input to the control circuit 110. Further, the control circuit 110 generates the control signal Ctrl-C for controlling the movement of the carriage 71 and the control signal Ctrl-P for controlling the transport of the medium P based on the scanning direction position information signal ENC and the discharge direction position information signal APG, and outputs the control signal Ctrl-C and the control signal Ctrl-P to the above-described movement mechanism 61 and the rotary mechanism 51.

The switch circuit 120 includes a switch circuit 121 and a switch circuit 122. The switch control signal SW, the image signal ePDATA1, and response data signals eREP11 and eREP12 are input to the switch circuit 120. Further, the switch circuit 120 operates based on the switch control signal SW, and generates the image data signals ePDATA11 and ePDATA12 and the response signal eREP1.

Specifically, the switch circuit 121 includes a demultiplexer or the like. The switch control signal SW and the image signal ePDATA1 are input to the switch circuit 121. When the switch control signal SW at the level H is input, the switch circuit 121 outputs the image signal ePDATA1, as the image data signal ePDATA11, to the conversion circuit 130. Further, when the switch control signal SW at the level L is input, the switch circuit 121 outputs the image signal ePDATA1, as the image data signal ePDATA12, to the conversion circuit 130. That is, the image signal ePDATA1 includes the image data signal ePDATA11 and the image data signal ePDATA12, the switch circuit 121 performs time division on the image signal ePDATA1 based on a logic level of the switch control signal SW, and outputs the image data signals ePDATA11 and ePDATA12.

Further, the switch circuit 122 includes a multiplexer or the like. The switch control signal SW and the response data signals eREP11 and eREP12 are input to the switch circuit 122. When the switch control signal SW at the level H is input, the switch circuit 122 selects the response data signal eREP11 and outputs the response signal eREP1 to the control circuit 110. Further, when the switch control signal SW at the level L is input, the switch circuit 122 selects the response data signal eREP12 and outputs the response signal eREP1 to the control circuit 110. That is, the switch circuit 122 selects the response data signal eREP11 or the response data signal eREP12 based on the logic level of the switch control signal SW, and outputs the response signal eREP1 which includes the response data signals eREP11 and eREP12.

The conversion circuit 130 is electrically coupled to the control circuit 110 through the switch circuit 120. Further, the conversion circuit 130 converts the image data signals ePDATA11 and ePDATA12 into image data signals oPDATA1 and oPDATA2 which are optical signals. In other words, the conversion circuit 130 converts the image signal ePDATA1, which includes the image data signals oPDATA1 and oPDATA2, into the optical signal. The conversion circuit 130 includes E/O circuits 131 and 132 and O/E circuits 133 and 134.

The E/O circuits 131 and 132 include light-emitting elements or the like, and convert the input electric signals into the optical signals. Specifically, the image data signal ePDATA11, which is the electric signal, is input to the E/O circuit 131. Further, the E/O circuit 131 converts the image data signal ePDATA11 into the image data signal oPDATA1 which is the optical signal. Further, the image data signal ePDATA12, which is the electric signal, is input to the E/O circuit 132. Further, the E/O circuit 132 converts the image data signal ePDATA12 into the image data signal oPDATA2 which is the optical signal.

The O/E circuits 133 and 134 include light receiving elements or the like, and convert the input optical signals into the electric signals. Specifically, the response data signal oREP1, which is the optical signal, is input to the O/E circuit 133. Further, the O/E circuit 133 converts the response data signal oREP1 into the response data signal eREP11 which is the electric signal. Further, the response data signal oREP2, which is the optical signal, is input to the O/E circuit 134. Further, the O/E circuit 134 converts the response data signal oREP2 into the response data signal eREP12 which is the electric signal.

Here, the conversion circuit 130 is an example of a second conversion circuit, the image data signal oPDATA1, which is acquired through conversion performed on the image data signal ePDATA11 included in the image signal ePDATA1, is an example of a first optical signal, and the image data signal oPDATA2, which is acquired through conversion performed on the image data signal ePDATA12 included in the image signal ePDATA1, is another example of the first optical signal.

The handshake signals HSs and HSb are input to the abnormality detection circuit 140. The abnormality detection circuit 140 detects whether or not the propagation path of the signals propagated between the control unit 10 and the head unit 20 is abnormal based on the input handshake signals HSs and HSb. Further, the abnormality detection circuit 140 generates the abnormality signal ERR indicative of the existence/non-existence of the abnormality, and outputs the abnormality signal ERR to the control circuit 110.

The abnormality notification signal EINF, which is generated by the control circuit 110 based on the abnormality signal ERR, is input to the abnormality notification circuit 150. When the input abnormality notification signal EINF is a signal which indicates that the abnormality occurs on the propagation path of the signals propagated between the control unit 10 and the head unit 20, the abnormality notification circuit 150 provides a notification that the abnormality occurs on the propagation path. The abnormality notification circuit 150 includes an LED element, and provides the notification of the abnormality by lighting, extinguishing, or blinking the LED element. The abnormality notification circuit 150 is not limited to the above-described configuration, and, for example, may have a configuration in which the notification that the abnormality occurs is displayed on a display or the like. That is, the abnormality notification circuit 150 is not limited to a configuration included in the main control circuit 100, and the abnormality notification circuit 150 may be provided in a position in which it is possible to provide the notification of the abnormality to the user.

The head unit 20 includes the discharge control circuit 200, the scanning direction position detection circuit 45, the discharge direction position detection circuit 46, and the image reading circuit 47. As described above, the scanning direction position detection circuit 45 detects the position of the liquid discharging head 400 in the X direction to which the carriage 71 moves, and generates the scanning direction position information signal ENC indicative of the position of the liquid discharging head 400 in the X direction. Further, the discharge direction position detection circuit 46 detects the position of the liquid discharging head 400 in the Z direction to which the liquid discharging head 400 discharges the liquid with respect to the medium P, and generates the discharge direction position information signal APG indicative of the position of the liquid discharging head 400 in the Z direction. Further, the image reading circuit 47 acquires the image information formed on the medium P, generates the image information signal CDATA indicative of the acquired image information, and outputs the image information signal CDATA to the discharge control circuit 200.

The discharge control circuit 200 includes the control circuit 210, the switch circuit 220, and the conversion circuit 230.

The conversion circuit 230 is electrically coupled to the control circuit 210 through the switch circuit 220. Further, the conversion circuit 230 converts the image data signals oPDATA1 and oPDATA2 into image data signals ePDATA21 and ePDATA22 which are the electric signals. Here, the conversion circuit 230 is an example of a first conversion circuit. The conversion circuit 230 includes O/E circuits 231 and 232, and E/O circuits 233 and 234.

The O/E circuits 231 and 232 include the light receiving elements or the like, and convert the input optical signals into the electric signals. Specifically, the image data signal oPDATA1, which is the optical signal, is input to the O/E circuit 231. Further, the O/E circuit 231 converts the image data signal oPDATA1 into the image data signal ePDATA21 which is the electric signal. Further, the image data signal oPDATA2, which is the optical signal, is input to the O/E circuit 232. Further, the O/E circuit 232 converts the image data signal oPDATA2 into the image data signal ePDATA22 which is the electric signal.

The E/O circuits 233 and 234 include the light-emitting element or the like, and convert the input electric signals into the optical signals. Specifically, a response data signal eREP21, which is the electric signal, is input to the E/O circuit 233. Further, the E/O circuit 233 converts the response data signal eREP21 into the response data signal oREP1 which is the optical signal. Further, a response data signal eREP22, which is the electric signal, is input to the E/O circuit 234. Further, the E/O circuit 234 converts the response data signal eREP22 into the response data signal oREP2 which is the optical signal.

The switch circuit 220 includes a switch circuit 221 and a switch circuit 222. The switch control signal SW, the image data signals ePDATA21 and ePDATA22, and the response signal eREP2 are input to the switch circuit 220. Further, the switch circuit 220 generates the image signal ePDATA2 and the response data signals eREP21 and eREP22 by performing the operation based on the switch control signal SW.

Specifically, the switch circuit 221 includes a multiplexer or the like. The switch control signal SW and the image data signals ePDATA21 and ePDATA22 are input to the switch circuit 221. When the switch control signal SW at the level H is input, the switch circuit 221 selects the image data signal ePDATA21, and outputs the image signal ePDATA2 to the control circuit 210. Further, when the switch control signal SW at the level L is input, the switch circuit 221 selects the image data signal ePDATA22, and outputs the image signal ePDATA2 to the control circuit 210. That is, the switch circuit 221 selects the image data signal ePDATA21 or the image data signal ePDATA22 based on the logic level of the switch control signal SW, and outputs the image signal ePDATA2 including the image data signals ePDATA21 and ePDATA22.

Further, the switch circuit 222 includes a demultiplexer or the like. Further, the switch control signal SW and the response signal eREP2 are input to the switch circuit 222. When the switch control signal SW at the level H is input, the switch circuit 222 outputs the response signal eREP2, as the response data signal eREP21, to the E/O circuit 233. Further, when the switch control signal SW at the level L is input, the switch circuit 222 outputs the response signal eREP2, as the response data signal eREP22, to the E/O circuit 234. That is, the response signal eREP2 includes the response data signal eREP21 and the response data signal eREP22. The switch circuit 222 performs time division on the response signal eREP2 based on the logic level of the switch control signal SW, and outputs the response data signals eREP21 and eREP22.

As above, the conversion circuit 230 converts the image data signal oPDATA1 into the image data signal ePDATA21 which is the electric signal, and converts the image data signal oPDATA2 into the image data signal ePDATA22 which is the electric signal. Further, the image data signals ePDATA21 and ePDATA22 are output as the image signal ePDATA2 through the switch circuit 220. In other words, the conversion circuit 230 converts the image data signals oPDATA1 and oPDATA2 into the image signal ePDATA2 which is the electric signal. Here, the image signal ePDATA2 is an example of a first signal.

The control circuit 210 includes a buffer area 211. Further, the control circuit 210 holds the input image signal ePDATA2 in the buffer area 211, and generates and outputs the response signal eREP2 as the reception signal Rx.

Further, the control circuit 210 generates the handshake signal HSb indicative of whether or not to receive various signals input from the control circuit 110 based on the handshake signal HSs input from the control circuit 110, and outputs the handshake signal HSb to the control circuit 110.

Further, the scanning direction position information signal ENC, the discharge direction position information signal APG, and the image information signal CDATA are input to the control circuit 210. Further, the control circuit 210 generates and outputs the printing data signal SI, the latch signal LAT, the change signal CH, the clock signal SCK, and the base driving signals dA and dB for controlling the drive of the piezoelectric element 60 based on the image signal ePDATA2 held in the buffer area 211, the scanning direction position information signal ENC, the discharge direction position information signal APG, and the image information signal CDATA. That is, the control circuit 210 controls the drive of the piezoelectric element 60 based on the image signal ePDATA2. The generated numbers of printing data signals SI, the latch signals LAT, the change signals CH, the clock signals SCK, and the base driving signals dA and dB, which are generated by the control circuit 210, may be plural according to the number of driving signal generation circuits 300 and the number of liquid discharging heads 400, the driving signal generation circuits 300 and the liquid discharging heads 400 being provided in the liquid discharging apparatus 1.

Here, the control circuit 210, which generates and outputs the printing data signal SI, the latch signal LAT, the change signal CH, the clock signal SCK, and the base driving signals dA and dB for controlling the drive of the piezoelectric element 60, is an example of a first circuit.

As shown in FIG. 14, the signals between the control unit 10 including the control circuit 110 and the head unit 20 including the control circuit 210 are propagated through cables 160, 170*a*, and 170*b* as the cables 82.

The cable 160 electrically couples the scanning direction position detection circuit 45, the discharge direction position detection circuit 46, the discharge control circuit 200 including the control circuit 210, and the main control circuit 100 including the control circuit 110. Further, the cable 160 propagates the scanning direction position information signal ENC, the discharge direction position information signal APG, the handshake signals HSs and HSb, and the switch control signal SW. The cable 160 is the propagation path for propagating the electric signals, and, preferably, is a flexible flat cable (FFC). When the cable 160 is formed of the FFC which is easily deformable and has high sliding characteristics, it is possible to propagate signals including the scanning direction position information signal ENC, the discharge direction position information signal APG, the handshake signals HSs and HSb, and the switch control signal SW, regardless of a structure, an operation, or the like of the liquid discharging apparatus 1. Here, the cable 160 is an example of a second cable.

Figure 15:
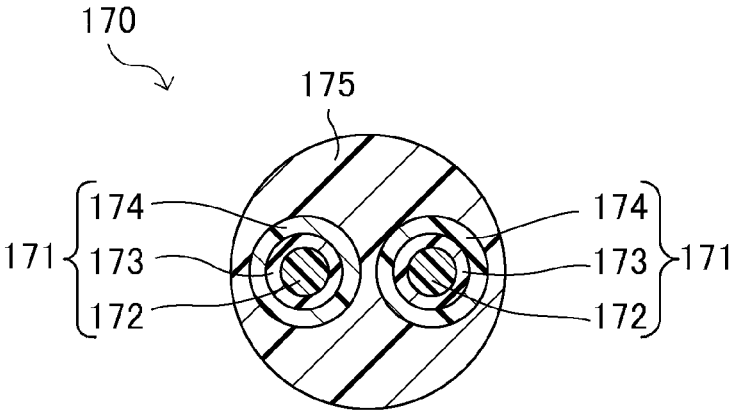
FIG. 15 is a diagram showing a schematic configuration of a cable for propagating an optical signal.

The cables 170*a* and 170*b* are for connecting the conversion circuit 130 to the conversion circuit 230. Further, the cables 170*a* and 170*b* are for propagating the image data signals oPDATA1 and oPDATA2, which are the optical signals, and the response data signals oREP1 and oREP2. Here, configurations of the cables 170*a* and 170*b* for propagating the optical signals will be described. FIG. 15 is a diagram showing schematic configurations of the cables 170*a* and 170*b* for propagating the optical signals. In FIG. 15, the cables 170*a* and 170*b* are illustrated as a cable 170.

The cable 170 includes two core wires 171 and a protective covering 175 for protecting the two core wires 171. The protective covering 175 has a configuration for protecting the core wires 171, and is formed of, for example, polyethylene or the like.

Each of the two core wires 171 includes a core 172, a cladding 173, and a core wire covering 174. The core 172 is a part for propagating the optical signals which are input to the cable 170, and is formed of quartz glass or the like which is excellent in light transmission. The cladding 173 is formed of a material which has a lower refractive index than the core 172. Therefore, light is reflected in a boundary between the core 172 and the cladding 173, and the optical signals are propagated inside the core 172. Further, the core wire covering 174 has a configuration for protecting the core 172 and the cladding 173, and is formed of a silicone resin or the like. The core wire covering 174 prevents a decrease in intensity due to damage or the like of the core 172 and the cladding 173, and stabilizes characteristics of the various signals propagated through the core wire 171.

Further, the image data signal oPDATA1 is propagated through one core wire 171 included in the cable 170*a* of the two cables 170, and the response data signal oREP1 is propagated through another core wire 171. Further, the image data signal oPDATA2 is propagated through one core wire 171 included in the cable 170*b* of the two cables 170, and the response data signal oREP2 is propagated through another core wire 171. In other words, the image signal ePDATA1 is propagated through both the cable 170*a* and the cable 170*b*, and the response signal eREP2 is propagated through both the cable 170*a* and the cable 170*b*.

Here, the configurations and materials of the cables 170*a* and 170*b* are not limited to the above description, and it is preferable that the cable 170*a* and the cable 170*b* have structures which are different from each other. The structures, which are different from each other, are structures in which the materials, shapes, thicknesses, or the like of the core 172, the cladding 173, the core wire covering 174, and the protective covering 175 are different. Therefore, a problem in that abnormalities simultaneously occur in both the cables 170*a* and 170*b* is reduced.

As above, when the image signal ePDATA1 based on the image signal PDATA is converted into the optical signal, which is capable of propagating a large capacity of data, and is propagated through the cables 170*a* and 170*b*, it is possible to propagate a larger quantity of data. Therefore, even when the number of nozzles 651 increases in order to improve a quality of the image to be formed on the medium P, it is possible to discharge the ink without reducing a discharge speed.

Here, the cable 170*a* for propagating the image data signal oPDATA1, which is the optical signal, is an example of a first cable, and the cable 170*b* for propagating the image data signal oPDATA2, which is the optical signal, is another example of the first cable.

Further, the image information signal CDATA, which is input to the control circuit 210, may be propagated, as the response signal eREP2, to the control circuit 110. That is, the image information signal CDATA may be converted into the optical signal in the conversion circuit 230, and may be propagated through the cable 170*a* or the cable 170*b*. Here, the response signal oREP, which is acquired by converting the image information signal CDATA into the optical signal, is an example of a second optical signal.

The image information signal CDATA is a signal for acquiring the image information formed on the medium P as described above and for indicating the acquired image information. Therefore, the image information signal CDATA has a large quantity of data. When the image information signal CDATA is propagated through the cable 160, there is a problem in that a communication speed of the signal propagated through the cable 160 is reduced. When the image information signal CDATA is converted into the optical signal and is propagated using the cables 170*a* and 170*b*, it is possible to stably propagate the image information signal CDATA whose quantity of data is large. Further, the response signal eREP2 has a small quantity of data with respect to the image signal ePDATA2. Therefore, when the image information signal CDATA is propagated to the control circuit 110 using the same propagation path as the response signal eREP2, it is not necessary to provide a new communication cable, and thus it is possible to reduce the number of signal lines for connecting the control unit 10 to the head unit 20.

In the liquid discharging apparatus 1 configured as above, a configuration, which includes the control circuit 110 and the conversion circuit 130 included in the control unit 10 for controlling the operation of the head unit 20 and the cables 170*a* and 170*b* for propagating the image data signals oPDATA1 and oPDATA2 corresponding to the optical signals generated by the control unit 10, is the driving circuit 11.

Figure 16:
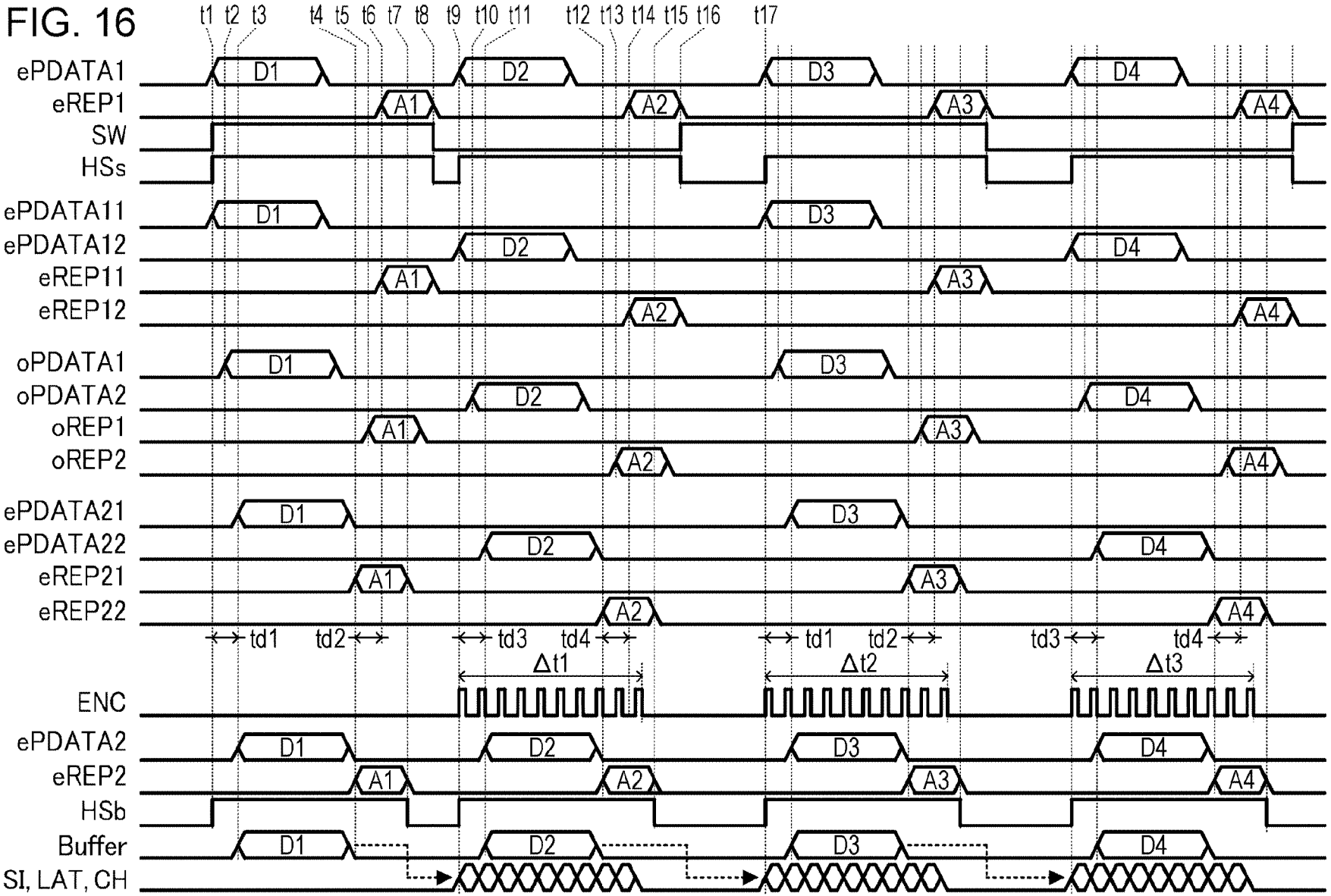
FIG. 16 is a timing chart view showing propagation of the signal between the control unit and the head unit.

Here, propagation of the signals between the control unit 10 and the head unit 20 will be described in detail. FIG. 16 is a timing chart view showing propagation of the signal between the control unit 10 and the head unit 20.

As shown in FIGS. 14 and 16, after the liquid discharging apparatus 1 is activated and it is determined that it is possible to propagate the signals between the control unit 10 and the head unit 20, the control circuit 110 sets the handshake signal HSs to the level H and sets the switch control signal SW to the level H at time t1. Further, the control circuit 110 generates image data D1 based on the image signal PDATA supplied from the host computer or the like, and outputs the image signal ePDATA1 to the switch circuit 120. At this time, since the switch control signal SW is at the level H, the image data D1 is input, as the image data signal ePDATA11, to the E/O circuit 131 through the switch circuit 121. Further, the image data D1 is converted into the optical signal in the E/O circuit 131. Further, the control circuit 210 detects the handshake signal HSs, which is output at time t1, at the level H, and outputs the handshake signal HSb at the level H to the control circuit 110.

The E/O circuit 131 outputs the image data D1, which is converted into the optical signal, as the image data signal oPDATA1, to the cable 170*a* at time t2. After the image data D1, which is converted into the optical signal, is propagated through the cable 170*a*, the image data D1 is input to the O/E circuit 231.

The O/E circuit 231 converts the image data D1, which is the optical signal, into the electric signal, and outputs the image data D1, as the image data signal ePDATA21, to the switch circuit 221 at time t3. At this time, since the switch control signal SW is at the level H, the image data D1 is input, as the image signal ePDATA2, to the control circuit 210 through the switch circuit 221. Further, the image data D1, which is input to the control circuit 210, is held in the buffer area 211.

Here, a time difference td1 between the time t1, at which the control circuit 110 outputs the image data D1, and the time t3, at which the image data D1 is input to the control circuit 210, includes a conversion time difference generated by converting the electric signal into the optical signal in the E/O circuit 131 and a conversion time difference generated by converting the optical signal into the electric signal in the O/E circuit 231. In other words, the image data D1, which is output from the control circuit 110, is delayed by the time difference td1, and is input to the control circuit 210.

At time t4, that is, after the image data D1 is completely input, the control circuit 210 generates and outputs a response data A1, as the response signal eREP2, to the switch circuit 222. At this time, since the switch control signal SW is at the level H, the response data A1, as the response data signal eREP21, is input to the E/O circuit 233 through the switch circuit 222. Further, the response data A1 is converted into the optical signal in the E/O circuit 233.

The E/O circuit 233 outputs the response data A1 which is the optical signal, as the response data signal oREP1, to the cable 170*a* at time t5. Further, after the response data A1, which is converted into the optical signal, is propagated through the cable 170*a*, the response data A1 is input to the O/E circuit 133.

At time t6, the O/E circuit 133 converts the response data A1, which is the optical signal, into the electric signal, and outputs the response data A1, as the response data signal eREP11, to the switch circuit 122. At this time, since the switch control signal SW is at the level H, the response data A1 is input, as the response signal eREP1, to the control circuit 110 through the switch circuit 122.

Here, a time difference td2 between the time t4, at which the control circuit 210 outputs the response data A1, and time t6, at which the response data A1 is input to the control circuit 110, includes a conversion time difference generated by converting the electric signal into the optical signal in the E/O circuit 233, and a conversion time difference generated by converting the optical signal into the electric signal in the O/E circuit 133. In other words, the response data A1, which is output from the control circuit 210, is delayed by the time difference td2, and is input to the control circuit 110.

When the response data A1, as the response signal eREP2, is completely output at time t7, the control circuit 210 sets the handshake signal HSb to the level L, and outputs the handshake signal HSb to the control circuit 110.

When the response data A1, as the response signal eREP1, is completely input and the handshake signal HSb at the level L is detected at time t8, the control circuit 110 sets the handshake signal HSs to the level L and sets the switch control signal SW to the level L.

At time t9, the control circuit 110 generates and outputs the control signal Ctrl-C for controlling the movement of the carriage 71. Therefore, the carriage 71 moves in a direction X1 along the X direction shown in FIG. 3. Further, in accordance with the movement of the carriage 71, the scanning direction position detection circuit 45 generates the scanning direction position information signal ENC. The scanning direction position information signal ENC is input to the control circuit 210 and is also input to the control circuit 110 through the cable 160. The control circuit 210 outputs the printing data signal SI, the change signal CH, the latch signal LAT, and the base driving signals dA and dB, which are generated based on the scanning direction position information signal ENC and the image data D1 held in the buffer area 211, to the various configurations shown in FIG. 5. Further, the control circuit 110 updates the control signal Ctrl-C for controlling the movement of the carriage 71 and the control signal Ctrl-P for controlling the transport of the medium P based on the input scanning direction position information signal ENC whenever necessary, and outputs the control signal Ctrl-C and the control signal Ctrl-P to the movement mechanism 61 and the rotary mechanism 51, which are described above.

That is, the control circuit 110 controls the movement of the carriage 71 and the transport of the medium P based on the scanning direction position information signal ENC, and the control circuit 210 generates and outputs the printing data signal SI for controlling the discharge of the ink, the change signal CH, the latch signal LAT, and the base driving signals dA and dB based on the scanning direction position information signal ENC. Since the scanning direction position information signal ENC is propagated, as the electric signal, through the cable 160, the above-described conversion time difference, generated when the electric signal is converted into the optical signal or the optical signal is converted into the electric signal, does not occur. Thus, a problem is reduced in that the time difference occurs between the control signals Ctrl-C and Ctrl-P for controlling the position at which the ink is discharged to the medium P, and the printing data signal SI for controlling the discharge of the ink to the medium P, the change signal CH, the latch signal LAT, and the base driving signals dA and dB. Therefore, the landing accuracy of the ink which is discharged with respect to the medium P is improved. In other words, a problem in that it is not possible to make the liquid accurately land on the medium is reduced.

Further, at time t9, the control circuit 110 sets the handshake signal HSs to the level H. Further, the control circuit 110 generates image data D2 based on the image signal PDATA supplied from the host computer or the like, and outputs the image signal ePDATA1 to the switch circuit 120. At this time, since the switch control signal SW is at the level L, the image data D2 is input, as the image data signal ePDATA12, to the E/O circuit 132 through the switch circuit 122. Further, the image data D2 is converted into the optical signal in the E/O circuit 132. Further, the control circuit 210 detects the output handshake signal HSs at the level H, and outputs the handshake signal HSb at the level H to the control circuit 110 at time t9.

At time t10, the E/O circuit 132 outputs the image data D2, which is converted into the optical signal, as the image data signal oPDATA2, to the cable 170*b*. After the image data D2, which is converted into the optical signal, is propagated through the cable 170*b*, the image data D2 is input to the O/E circuit 232.

At time t11, the O/E circuit 232 converts the image data D2, which is the optical signal, into the electric signal, and outputs the image data signal ePDATA22 to the switch circuit 222. At this time, since the switch control signal SW is at the level L, the image data D2 is input, as the image signal ePDATA2, to the control circuit 210 through the switch circuit 222. Further, the image data D2, which is input to the control circuit 210, is held in the buffer area 211.

Here, the time difference td2 between the time t9, at which the control circuit 110 outputs the image data D2, and the time t11, at which the image data D2 is input to the control circuit 210, includes a conversion time difference generated by converting the electric signal into the optical signal in the E/O circuit 132, and a conversion time difference generated by converting the optical signal into the electric signal in the O/E circuit 232. In other words, the image data D2, which is output from the control circuit 110, is delayed by the time difference td2, and is input to the control circuit 210.

At time t12, that is, after the image data D2 is completely input, the control circuit 210 generates and outputs response data A2, as the response signal eREP2, to the switch circuit 222. At this time, since the switch control signal SW is at the level L, the response data A2 is input, as the response data signal eREP22, to the E/O circuit 234 through the switch circuit 222. Further, the response data A2 is converted into the optical signal in the E/O circuit 234.

At time t13, the E/O circuit 234 outputs the response data A2, which is the optical signal, as the response data signal oREP2, to the cable 170*b*. Further, after the response data A2, which is converted into the optical signal, is propagated through the cable 170*b*, the response data A2 is input to the O/E circuit 134.

At time t14, the O/E circuit 134 converts, the response data A2, which is the optical signal, into the electric signal, and outputs the response data signal eREP12 to the switch circuit 122. At this time, since the switch control signal SW is at the level L, the response data A2 is input to, as the response signal eREP1, the control circuit 110 through the switch circuit 122.

Here, a time difference td4 between the time t12, at which the control circuit 210 outputs the response data A2, and the time t14, at which the response data A2 is input to the control circuit 110, includes a conversion time difference generated by converting the electric signal into the optical signal in the E/O circuit 234, and a conversion time difference generated by converting the optical signal into the electric signal in the O/E circuit 134. In other words, the response data A2, which is output from the control circuit 210, is delayed by the time difference td4 and is input to the control circuit 110.

When the response data A2, as the response signal eREP2, is completely output at time t15, the control circuit 210 sets the handshake signal HSb to the level L and outputs the handshake signal HSb to the control circuit 110.

When the response data A2, as the response signal eREP1, is completely input and the handshake signal HSb at the level L is detected at time t16, the control circuit 110 sets the handshake signal HSs to the level L and sets the switch control signal SW to the level H.

At time t17, the control circuit 110 generates and outputs the control signal Ctrl-C for reversing and controlling the movement direction of the carriage 71. Therefore, the carriage 71 moves in a direction X2, which is different from the direction X1, along the X direction shown in FIG. 3. Therefore, the carriage 71 reciprocates. Further, in accordance with the movement of the carriage 71, the scanning direction position detection circuit 45 generates the scanning direction position information signal ENC. The scanning direction position information signal ENC is input to the control circuit 210 and is also input to the control circuit 110 through the cable 160. The control circuit 210 outputs the printing data signal SI, the change signal CH, the latch signal LAT, and the base driving signals dA and dB, which are generated based on the scanning direction position information signal ENC and the image data D2 held in the buffer area 211, to the various configurations shown in FIG. 5. Further, the control circuit 110 updates the control signal Ctrl-C for controlling the movement of the carriage 71 and the control signal Ctrl-P for controlling the transport of the medium P based on the input scanning direction position information signal ENC whenever necessary, and outputs the control signal Ctrl-C and the control signal Ctrl-P to the movement mechanism 61 and the rotary mechanism 51, which are described above.

Further, the control circuit 110 generates image data D3 based on the image signal PDATA supplied from the host computer or the like, and outputs the image signal ePDATA1 to the switch circuit 120. Thereafter, the control unit 10 and the head unit 20 repeat the same operations.

As above, in the exemplary embodiment, the image signal ePDATA generated based on the image signal PDATA is propagated through the cables 170*a* and 170*b*. Specifically, the cable 170*a* is used to propagate the image data signal oPDATA1 which is the optical signal in a period Δt2, and the cable 170*b* is used to propagate the image data signal oPDATA2 which is the optical signal in a period Δt1 that is different from the period Δt2. Here, in the period Δt1 during which the carriage 71 moves in the direction X1, the image data signal oPDATA2, which is the optical signal, is propagated through both the cable 170*a* and the cable 170*b*. Further, in the period Δt2 during which the carriage 71 moves in the direction X2 which is different from the direction X1, the image data signal oPDATA1, which is the optical signal, may be propagated through both the cable 170*a* and the cable 170*b*. However, as illustrated in the exemplary embodiment, it is preferable that the image data signal oPDATA2, which is the optical signal, is not propagated through the cable 170*a* in the period Δt1, and the image data signal oPDATA1, which is the optical signal, is not propagated through the cable 170*b* in the period Δt2. Therefore, it is possible to reduce power consumption of the control circuit 110 which generates the image signal ePDATA based on the image signal PDATA. In the above description, the image signal ePDATA generated based on the image signal PDATA is propagated through the two cables 170*a* and 170*b*. However, one cable, which is capable of propagating the optical signal, or three or more cables may be used.

5. Effects

In the above-described liquid discharging apparatus 1 according to the exemplary embodiment, the image signal ePDATA2 for controlling the drive of the piezoelectric element 60 which discharges the ink from the liquid discharging head 400 is used to convert the image signal ePDATA1 generated in the control circuit 110 into the optical signal, and is propagated through the cables 170*a* and 170*b*. Therefore, it is possible to propagate a large quantity of image data signals. Further, the position information signal indicative of the position of the liquid discharging head 400 is propagated through the cable 160 without being converted into the optical signal. Thus, in the position information signal which is input to the control circuit 110, the conversion time difference, generated when the electric signal is converted into the optical signal or the optical signal is converted into the electric signal, is not generated. That is, the time difference is reduced which is generated between the position information signal generated by the head unit 20 and the position information signal input to the control circuit 110. Therefore, between the control of the drive of the piezoelectric element 60 in the control circuit 210 included in the head unit 20 and various controls in the control circuit 110, the time difference, which is generated between an actual position of the head unit and discharge timing of the ink discharged by the print head, is reduced. Therefore, a problem in that it is not possible to land the ink at an accurate position of the medium P is reduced.

6. Modification Example

Although it has been described that the above-described liquid discharging apparatus 1 is a serial-type ink jet printer in which the liquid discharging head 400 that discharges the ink is mounted on the carriage 71 and which performs printing as the carriage 71 reciprocates on the medium P, the liquid discharging head 400 may be a so-called line-type ink jet printer in which the liquid discharging heads 400 are arranged side by side in a width direction of the medium P and which performs printing as the medium P is transported.

Although the exemplary embodiments and the modification examples have been described above, the present disclosure is not limited to these exemplary embodiments, and may be carried out in various modes without departing from the gist thereof. For example, the above-described embodiments can be combined appropriately.

The present disclosure includes a configuration having the same function, method, and result as the configuration described in the exemplary embodiment or a configuration having substantially the same purpose and effect. Further, the present disclosure includes configurations in which nonessential parts of the configurations described in the embodiments are replaced. Further, the present disclosure also includes configurations that have the same effects as those of the embodiments or configurations that can achieve the same objects as those of the embodiments. Further, the present disclosure includes a configuration obtained by adding a Known technique to the configurations described in the embodiments.

What is claimed is:

1. A liquid discharging apparatus comprising:

a head unit; and a driving circuit that drives the head unit, wherein the head unit includes a liquid discharging head that has a driving element, and that discharges a liquid with respect to a medium by driving the driving element, a position detection circuit that outputs a position information signal indicative of a position of the liquid discharging head, a first circuit that controls drive of the driving element based on a first signal, and a first conversion circuit that is electrically coupled to the first circuit, and that converts a first optical signal into the first signal, the driving circuit includes a second circuit that outputs a second signal, a second conversion circuit that is electrically coupled to the second circuit, and that converts the second signal into the first optical signal, a first cable, and a second cable, the first cable connects the first conversion circuit to the second conversion circuit, and propagates the first optical signal, and the second cable electrically couples the position detection circuit to the second circuit, and propagates the position information signal.

2. The liquid discharging apparatus according to claim 1, wherein the second signal is a signal indicative of image data to be formed on the medium.

3. The liquid discharging apparatus according to claim 1, further comprising:

a carriage on which the liquid discharging head is mounted, and which moves while facing the medium, wherein the position information signal includes a first position information signal indicative of the position of the liquid discharging head in a direction in which the carriage moves.

4. The liquid discharging apparatus according to claim 1, wherein the position information signal includes a second position information signal indicative of the position of the liquid discharging head in a direction in which the liquid is discharged with respect to the medium.

5. The liquid discharging apparatus according to claim 1, wherein the head unit includes an image reading circuit that acquires image information formed on the medium, the image reading circuit outputs an image information signal indicative of the acquired image information, and the image information signal is converted into a second optical signal in the first conversion circuit, and is propagated through the first cable.

6. The liquid discharging apparatus according to claim 1, wherein the second cable is a flexible flat cable.

7. A driving circuit for driving a head unit including a liquid discharging head that has a driving element, and that discharges a liquid with respect to a medium by driving the driving element, a position detection circuit that outputs a position information signal indicative of a position of the liquid discharging head, a first circuit that controls drive of the driving element based on a first signal, and a first conversion circuit that is electrically coupled to the first circuit, and that converts a first optical signal into the first signal, the driving circuit comprising:

a second circuit that outputs a second signal, a second conversion circuit that is electrically coupled to the second circuit, and that converts the second signal into the first optical signal, a first cable, and a second cable, wherein the first cable connects the first conversion circuit to the second conversion circuit, and propagates the first optical signal, and the second cable electrically couples the position detection circuit to the second circuit, and propagates the position information signal.

* * * * *